US008299986B2

(12) United States Patent
Senda et al.

(10) Patent No.: US 8,299,986 B2
(45) Date of Patent: Oct. 30, 2012

(54) DRIVING CIRCUIT FOR DISPLAY DEVICE, AND DISPLAY DEVICE

(75) Inventors: Takahiro Senda, Tenri (JP); Akira Tagawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 665 days.

(21) Appl. No.: 12/391,386

(22) Filed: Feb. 24, 2009

(65) Prior Publication Data

US 2009/0153546 A1 Jun. 18, 2009

Related U.S. Application Data

(62) Division of application No. 10/929,058, filed on Aug. 27, 2004, now Pat. No. 7,515,126.

(30) Foreign Application Priority Data

Aug. 28, 2003 (JP) ..... 2003-209331
Jun. 24, 2004 (JP) ..... 2004-186969

(51) Int. Cl.
*G09G 3/30* (2006.01)

(52) U.S. Cl. ..... 345/77; 345/82; 345/98

(58) Field of Classification Search ..... 345/76, 345/77, 82, 83, 98, 99, 100, 213, 204
See application file for complete search history.

(56) References Cited

U.S. PATENT DOCUMENTS 6,417,847 B1 * 7/2002 Mametsuka ..... 345/213
2004/0090434 A1 * 5/2004 Miyazawa ..... 345/204

OTHER PUBLICATIONS

K. Inukai et al.; "40-in. TFT-OLED Displays and a Novel Digital Driving Method"; Late-News Paper; SID 00 Digest; pp. 924-927.*
K. Inukai et al.;"4.0-in. TFT-OLED Displays and a Novel Digital Driving Method"; Late-News Paper; SID 00 Digest; pp. 924-927.*
Senda et al., "Driving Circuit for Display Device, and Display Device", U.S. Appl. No. 12/342,348, filed Dec. 23, 2008.
Senda et al.: "Driving Circuit for Display Device, and Display Device"; U.S. Appl. No. 10/929,058, filed Aug. 27, 2004.
Senda et al.: "Driving Circuit for Display Device, and Display Device"; U.S. Appl. No. 12/391,382, filed Feb. 24, 2009.

* cited by examiner

*Primary Examiner* — Quan-Zhen Wang
*Assistant Examiner* — Troy Dalrymple
(74) *Attorney, Agent, or Firm* — Keating & Bennett, LLP

(57) ABSTRACT

A driving circuit of a display device includes digital/current converting (DCC) circuits, one for each data line. The DCC circuit operates to charge a capacitor with a reference current according to a supplied signal from a shift register. The DCC circuit stores a current value of the reference current and outputs it to a data line via a switching element that has been turned on by a digital image data signal of a single line supplied from a line latch. The output value of each DCC circuit is reset, one after another, in every select scan period in which an OFF signal is sent to all the data lines. In this way, the reset of the output value and the output of the image data signal can be successively carried out within one frame period, enabling the data to be applied to the pixel circuit.

5 Claims, 24 Drawing Sheets

DRIVING CIRCUIT FOR DISPLAY DEVICE, AND DISPLAY DEVICE

This Nonprovisional application claims priority under 35 U.S.C. §119(a) on Patent Application No. 2003-209331 filed in Japan on Aug. 28, 2003, and No. 2004-186969 filed in Japan on Jun. 24, 2004, the entire contents of which are hereby incorporated by reference.

FIELD OF THE INVENTION

The present invention relates to a current-controlled driving circuit and a driving method for active-matrix display devices using an electro-optic element. The present invention particularly relates to a display device in which an output value of the driving circuit is reset using a select scan period that is provided to send an OFF image data signal from the driving circuit to pixel circuits through all data lines within one frame period.

BACKGROUND OF THE INVENTION

The arrival of the information age has created a demand for light-weight, thin, and fast-response displays, initiating active research and development of organic EL (Electro Luminescence) displays and FED (Field Emission Device). The organic EL display is also known as an organic LED, which is expected to be used in the areas of portable terminal devices by virtue of its self-emitting property and low voltage operation and low power consumption.

The organic EL display is available in two types: the passive-matrix type and the active-matrix type, of which the latter is expected to be the main stream scheme in the future. The driving method of the organic EL display is either voltage-controlled or current-controlled, wherein each type of driving method uses either digital driving or analog driving. That is, the driving method of the organic EL display can be divided into four major driving modes.

In the organic EL display, even a slight voltage change causes a large luminance fluctuation, owing to the non-linear luminance-voltage characteristics of the organic EL element. Further, since its characteristic curve easily fluctuates in response to a change in drive time or ambient temperature of the element, it is very difficult to suppress luminance variations by a voltage-controlled driving method. On the other hand, the luminance-current characteristics of the organic EL element have a proportional relationship, and the influence of ambient temperature is small. It is therefore easier to control luminance by current. Indeed, the current-control is a more preferable method of driving the organic EL display.

The TFT (Thin Film Transistor), which is a switching element for the pixel circuit and driving circuit, is realized by amorphous silicon, low-temperature polysilicon, or CG (Continuous Grain) silicon. Generally, the low-temperature polysilicon or CG silicon is used for the TFT since they can accommodate large currents that are sufficient to provide a relatively large current level required for driving the organic EL element. The low-temperature polysilicon and CG silicon are also preferable as TFT materials in terms of display cost and display size, since they enable peripheral circuits to be formed on the same glass material where the display elements are formed.

One example of an organic EL display using the current-controlled driving mode and in which peripheral circuits are incorporated on the glass substrate is a current-driver integrated organic EL display disclosed in Japanese Publication for Unexamined Patent Publication No. 195812/2003 (Tokukai 2003-195812, published on Jul. 9, 2003), as shown in FIG. 19.

In a data driving circuit 100 shown in FIG. 19, an externally supplied digital image data signal is fed to a data latch 102 at a generated timing of a shift register 101, and data of one scan line (digital image data signal) is stored in a line latch 103. The stored data is then converted into a 6-bit analog signal in a voltage/current converting circuit 104, and is outputted to data lines S1 through S120 of a display panel 109 through a 1-to-2 selector 106.

The voltage/current converting circuit 104 refers to 6-bit reference currents Is through Is×32 supplied from a reference current source 107 and resets (refreshes) its output value, so as to convert the output 6-bit digital image data signal of the line latch 103 into the 6-bit analog signal for output. The shift register 105 supplies timings of applying the reference currents. This is carried out in synchronism with the period in which the voltage/current converting circuit 104 does not output the analog signal.

A gate driving circuit 108 receives a select-scan line signal from outside, and selects scan lines G1 through G136 of the display panel 109 in a predetermined order for pulse driving.

FIG. 20 illustrates details of the voltage/current converting circuit 104 shown in FIG. 19.

The voltage/current converting circuit 104 includes sets of 6-bit DCC circuits 201, each having six voltage/current converting circuits (1-bit DCC) of a current-copier type. Each DCC circuit 201 holds (stores) a reference 6-bit current value in its 1-bit DCC capacitor, and either outputs or does not output the stored current value according to each bit of the externally supplied 6-bit digital image data signal. The stored current value is outputted when the driving switching element is ON, and is not outputted when it is OFF.

Further, in the DCC circuit 201, an A/B selector 204 selects one of the outputs respectively produced in a 6-bit DCC-A202 and a 6-bit DCC-B203 making up a pair. The selected output is supplied to data lines Sj via the 1-to-2 selector 106. That is, the voltage/current converting circuit 104 includes sixty DCC circuits 201, each having a pair of 6-bit DCC-A202 and 6-bit DCC-B203.

Here, the data driving circuit 100 is configured for a monochromatic 6-bit input signal, and only ⅓ of the structure is shown for an RGB full color display device, for example (FIG. 19 only shows a configuration for red (R)).

FIG. 21 is a timing chart representing operations of the data driving circuit 100.

As shown in FIG. 21, one frame includes recurrently alternating frame A and frame B.

In frame A, the signal output to the pixel circuits is controlled such that the outputs D1-B1 through D1-B6 of the line latch 103 are all OFF, and such that only 6-bit data DCC-A1 through DCC-A6 are supplied to the 1-to-2 selector 106 by the A/B selector 204. Further, in frame A, the shift register 105 outputs timing signals MSB1 through MSB60 of a high (H) level as current memory pulses. Accordingly, only the 6-bit DCC-B203 is refreshed in turn by the timing signals MSB1 through MSB60. Here, only the current value (image data signal) stored in the 6-bit DCC-A202 is outputted according to the 6-bit data D1-A1 through D1-A6 supplied from the line latch 103 (Iout1).

Conversely, in frame B, the shift register 105 outputs timing signals MSA1 through MSA60 of a high (H) level as current memory pulses. Accordingly, only the 6-bit DCC-A202 is refreshed in turn by the timing signals MSA1 through MSA60. Here, only the current value (image data signal)

stored in the 6-bit DCC-B203 is outputted according to the 6-bit data D1-B1 through D1-B6 supplied from the line latch 103 (Iout1).

In frame A or frame B, the output period of the supplied signal to the pixel circuits is divided into two parts. In other words, one horizontal scan period for selecting and scanning a single gate line is divided into two periods. The 1-to-2 selectors 106 are switched in synchronism with a switch timing of these two periods.

In this way, in the first half (1st H) of one horizontal scan period, the signal is supplied to only those pixel circuits connected to the odd-numbered or even-numbered data lines of the selected scan lines. In the second half (2nd H) of the horizontal scan period, the signal is supplied to the pixel circuits connected to the other half of the data lines. In effect, in the configuration shown in FIG. 20, the 6-bit DCC201 with a pair of 6-bit DCC-A202 and 6-bit DCC-B203 is used for each data line to operate the display device.

FIG. 22(*a*) through FIG. 22(*d*) show an operation of a 1-bit DCC205, which is a basic unit of the data driving circuit 100. As shown in FIG. 22(*a*), the 1-bit DCC205 includes a current memory signal line MSj, a digital signal line Dj, a reference current signal line SCLn, a signal output line Ioutj, switching elements SW101 through SW103, a switching element SWD101 across which a reference current Is×n is flown, and a capacitor Cs101. The source-drain voltage of the switching element SWD101 corresponding to the reference current Is×n is held in the capacitor Cs101. Using this operation of the switching element SWD101 and the capacitor Cs101, the 1-bit DCC205 holds the current value Is×n, which is the output value of the switching element SWD101.

When the current memory signal line MSj and the digital signal line Dj become high potential and low potential, respectively, the switching elements SW101 and SW102 are turned on, and the switching element SW103 is turned off. In response, as shown in FIG. 22(*b*), the reference current Is×n flows to ground through the reference current signal line SCLn and the switching elements SW101 and SWD101. Simultaneously, the capacitor Cs101 is charged through the switching element SW102 so as to obtain a gate-source voltage that is in accordance with the reference current.

Then, as shown in FIG. 22(*c*), the current memory signal line MSj is brought to low potential (L) with the digital signal line Dj held at low potential (L). This turns off the switching elements SW101 and SW102. As a result, the capacitor Cs101 holds a gate-source voltage that causes the switching element SWD101 to flow the reference current. Finally, as shown in FIG. 22(*d*), the digital signal line Dj is brought to high potential (H) with the current memory signal line MSj held at low potential (L). This turns on only the switching element SW103. As a result, the same current value stored in the capacitor Cs101 is supplied to the output line Ioutj connected to the pixel circuits.

The state shown in FIG. 22(*b*) represents the DCC refresh operation. FIG. 22(*c*) represents a state in which the current value is held, or "OFF (no emission)" is selected with a digital signal of a corresponding bit. FIG. 22(*d*) represents a state in which "ON (emission)" is selected with a digital signal of a corresponding bit.

It should be noted here that the pixel circuit used in the display device of the current-controlled analog driving mode proposed in Publication (1) below is described in detail in Publication (2). Accordingly, no explanation will be given therefor.

(1) K. Abe et al. "A Poly-Si TFT 6-bit Current Data Driver for Active Matrix Organic Light Emitting Diode Displays", EuroDisplay 2002, pp. 279-282.

(2) M. Shimoda et al. "New Pixel-Driving Scheme with Data-Line Pre-Charge Function for Active Matrix organic Light Emitting Diode Displays", IDW '02, pp. 239-242.

(3) R. Hattori, "Data-Line Driver circuits for Current-ProgrammeDCCtive-Matrix OLED Based on Poly-Si TFTs", AM-LCD2002, Jul. 10-12, 2002, pp. 17-20.

The data driving circuit of Publication (1) realizes the current-controlled analog driving for 6-bit gradation display for each color of RGB. This is realized by the voltage/current converting circuit that uses pairs of 6-bit DCCs which are provided in a number corresponding to the number of 6-bit display gradations, wherein the basic unit of the 6-bit DCCs is a 1-bit DCC that includes four switching elements and a single charge-holding-element.

However, in the driving methods proposed in Publications (1) and (2), the pixel signal stored in the data driving circuit is not a voltage but is a current, and the reference current source for the stored current is provided one for each bit. Accordingly, the 1-bit DCCs, which are provided in parallel, cannot store the current at the same time. In order to store current at the same time, a plurality of reference current sources needs to be provided for each bit. However, such a structure is not practical since it may cause luminance variations in the display device. It is therefore preferable that a single reference current source be provided for each bit, and that the 1-bit DCCs be individually refreshed at different timings.

As described in Publication (3), the time required for the 1-bit DCC to store a current is on the order of several microseconds, though it depends on the characteristics of the electro-optic element or switching element used in the display device. Publication (3) also describes that more time is needed to store the current as its current value becomes smaller.

Details of Publication (1) are disclosed in Japanese Unexamined Patent Publication No. 195812/2003 (Tokukai 2003-195812).

As described above, the current driving circuit disclosed in Publication (1) includes two 6-bit DCCs 201 (6-bit DCC-A202 and 6-bit DCC-B203) for each data line. The current driving circuit operates such that the 6-bit DCC-B203 stores a current while the 6-bit DCC-A202 outputs s signal to the pixels. Conversely, the 6-bit DCC-A202 stores a current during the output period of the 6-bit DCC-B203. With this operation of the current driving circuit, the 1-bit DCC can store a current only when the switching element SW3 of the 1-bit DCC is OFF, i.e., when all of the digital signal lines Dj are at low potential (all the bits of the 6-bit data D-A1 through D-A6 or D-B1 through D-B6 are "0"), as described above. Further, as noted above, the 1-bit DCC requires some time to store current.

With the 6-bit DCC-A202 or 6-bit DCC-B203 alone, a low-potential state for all the digital image data signals is attained only during the scan period of an nth line and (n+1)th line, i.e., during the non-output period of the image data signals from the DCC circuit 201 to the pixel circuits. In common display devices, such a low-potential period is only about several times longer than a required refresh period for the 1-bit DCC described in Publication (3), and is insufficient to refresh all the 1-bit DCCs in the display device. The 6-bit DCC-A202 and 6-bit DCC-B203 are used in pairs in order to provide enough of a refresh period for the 1-bit DCC.

Further, in the driver-integrated display device incorporating an electro-optic element, low-temperature polysilicon or CG silicon needs to be used as a semiconductor material for the TFT provided as a switching element. For this reason, the element characteristics tend to vary even between adjacent elements. Such variations of TFT characteristics can be suppressed when the size of TFT is increased to some extent. If the size of TFT were to be increased in the circuit disclosed in Publication (1) for example, then the circuit would require a considerably large area. Further, since the number of required TFT elements is large, even a defect in a single element can easily lead to errors in the entire operation of the circuit.

As described so far, a problem of the conventional techniques is the inability of the 1-bit DCCs to simultaneously store the current. In order to overcome this drawback, many conventional display devices for carrying out n-bit gradation display use a method of operation in which a pair of n-bit DCCs, which is provided for each data line, operates alternately in two operation modes in frame A and frame B provided in one frame period. In frame A, one of the n-bit DCC outputs current while the other stores current. In frame B, this operation of the n-bit DCCs is reversed. A drawback of this method, however, is that it requires a considerably large data driving circuit, because a pair of n-bit DCCs is required for each data line. Another drawback is that the n-bit DCCs need to be connected to the data line via a switching circuit (A/B selector 204), so as to switch the n-bit DCCs connected to the data line between frame A and frame B.

Further, in the driving circuit disclosed in Publication (1), the n-bit DCC installed in the device is provided one for each data line. This structure requires an additional 1-to-2 selector circuit for switching two data lines to be connected to the DCC.

In this manner, in order to send image data signals to the pixel circuits, one horizontal scan period is divided and the 1-to-2 selector or A/B selector is used to switch the n-bit DCCs connected to a single data line. This increases the operating frequency of the data driving circuit and thereby increases power consumption.

Further, dividing one horizontal scan period reduces the write time of the image data signals to the pixel circuits. As with the 1-bit DCC in the data driving circuit, the pixel circuits require a longer write time for smaller current. It is therefore not preferable to reduce the horizontal scan period.

As described above, the method in which two n-bit DCCs making up a pair are alternately operated for the operations of refreshing and signal output is disadvantageous in terms of miniaturization and whole power consumption of the device. Further, the probability of circuit defect increases as the size of the driving circuit is increased by the provision of complicated circuits such as the 1-bit DCCs, making it difficult to ensure reliability and productivity at the same time for the display device.

SUMMARY OF THE INVENTION

In order to overcome the problems described above, preferred embodiments of the present invention provide a display device driving method and a display device driving circuit that require only a single n-bit DCC to be connected to each data line and thereby enables a display device to successively carry out writing and refreshing of an image data signal within one frame period. These advantages are attained by providing a non-display signal scan period in one frame period, and by refreshing the 1-bit DCC in the non-display signal scan period.

In order to attain the foregoing advantages, a preferred embodiment of the present invention provides a driving circuit for driving a pixel circuit in a display device that includes a plurality of scan lines, at least one data line, and the pixel circuit, wherein the pixel circuit includes an electro-optic element and is disposed in a matrix at each intersection of the scan lines and the data line, the driving circuit including: a signal output circuit which holds a current value of a reference ON signal that turns on the electro-optic element, the signal output circuit outputting the ON signal to the data line with a current value held according to ON data, and outputting an OFF signal to the data line so as to turn off the electro-optic element according to OFF data; and a control circuit which controls the hold operation of the signal output circuit so as to enable the ON signal to reset its current value within a set period in which a display state of all pixel circuits on a selected scan line is set to a specific state.

Note that, the term "OFF signal" is used in instances not where the output of the signal output circuit is turned on to output a display signal such as the image data signal to the data lines, but in instances where the electro-optic element is turned off by not supplying the display signal thereto with the output of the signal output circuit turned off. This is a state where an OFF current value is applied to the data lines so that the pixel circuits do not emit light. For convenience of explanation, this is described as "sending an OFF signal." This enables the signal output circuit to reset its current value.

In the foregoing structure, the control circuit resets the current value for all signal output circuits within a set period in which all the signal output circuits always output the OFF signal. This enables the transmission of the image data signal and the reset of the output value to be successively carried out.

As a result, it is not required to provide two kinds of frame periods in which the signal output circuit operates differently. Accordingly, only one signal output circuit needs to be connected to each data line.

Note that, as described in conjunction with the conventional art, the signal output circuits such as DCCs are generally refreshed (reset) as a whole in synchronism with one frame period. Preferred embodiments of the present invention can use such a driving method that is carried out in synchronism with one frame period. However, the present invention is not just limited to such a refresh method and the present invention may be adapted to reset all the signal output circuits over a plurality of frames, as will be described later. The present invention may also be adapted to reset all signal outputs in a period shorter than one frame period.

The driving circuit and display device of preferred embodiments of the present invention preferably have a structure according to the time-division gradation display method in which, for example, a blanking scan period is provided as the set period, and the current value of one or more signal output circuits is successively reset in one blanking scan period. This enables the transmission of the image data signal and the reset of the current value to be successively carried out within one frame period, reducing the number of unit circuits making up the driving circuit. This reduces the circuit scale and operating frequency of the driving circuit. The present invention is therefore suitable for active-matrix display devices using an electro-optic element.

Other features, elements, steps, characteristics and advantages of the present invention will become more apparent from the following detailed description of preferred embodiments thereof taken in conjunction with the accompanying drawings.

DETAILED DESCRIPTION OF PREFERRED EMBODIMENTS

Preferred embodiments of the present invention are described below with reference to FIG. 1 through FIG. 18, and FIG. 23 through FIG. 25.

A driving method according to preferred embodiments of the present invention is preferably used in an active-matrix display device using a current-controlled driving mode with an organic EL element used as an electro-optic element. Further, in a driving circuit of preferred embodiments, a switching element is realized by TFT whose semiconductor material is low-temperature polycrystalline silicon or CG silicon. The driving circuit is provided in the same substrate on which pixel circuits including the electro-optic element are provided. Further, the driving circuit includes a digital/current converting (DCC) circuit that stores a reference current and sends the stored current as an image data signal to the pixels.

As to the structure and fabrication process of the CG silicon TFT used as a switching element, no detailed explanation will be made since they are described in detail in Publications (a) and (b) below for example. Further, no detailed explanation will be given for an organic EL element since it is described in detail in Japanese Unexamined Patent Publication No. 176580/1999 (Tokukaihei 11-176580).

(a) "4.0-in. TFT-OLED Displays and a Novel Digital Driving Method", 34.6, Late-News Paper, SID '00 Digest, pp. 924-927.

(b) "Continuous Grain Silicon Technology and Its Applications for Active Matrix Display" AM-LCD 2000, pp. 25-28.

First Preferred Embodiment

In the present preferred embodiment, the electro-optic element changes its display state M times in one frame period (where M is an integer of not less than 1), and the display state is set to be any one of R display states (where R is an integer of not less than 2) as determined by the current output of the DCC circuit DC. Based on this driving method, the following will describe an example of a structure of a display device that carries out N gradation display ($N \leqq R^M$) with $M \geqq 2$, i.e., a display device using a common digital driving mode with the foregoing driving method. The digital driving mode is described in Japanese Unexamined Patent Publication No. 108264/2002 (Tokukai 2002-108264).

Figure 2:
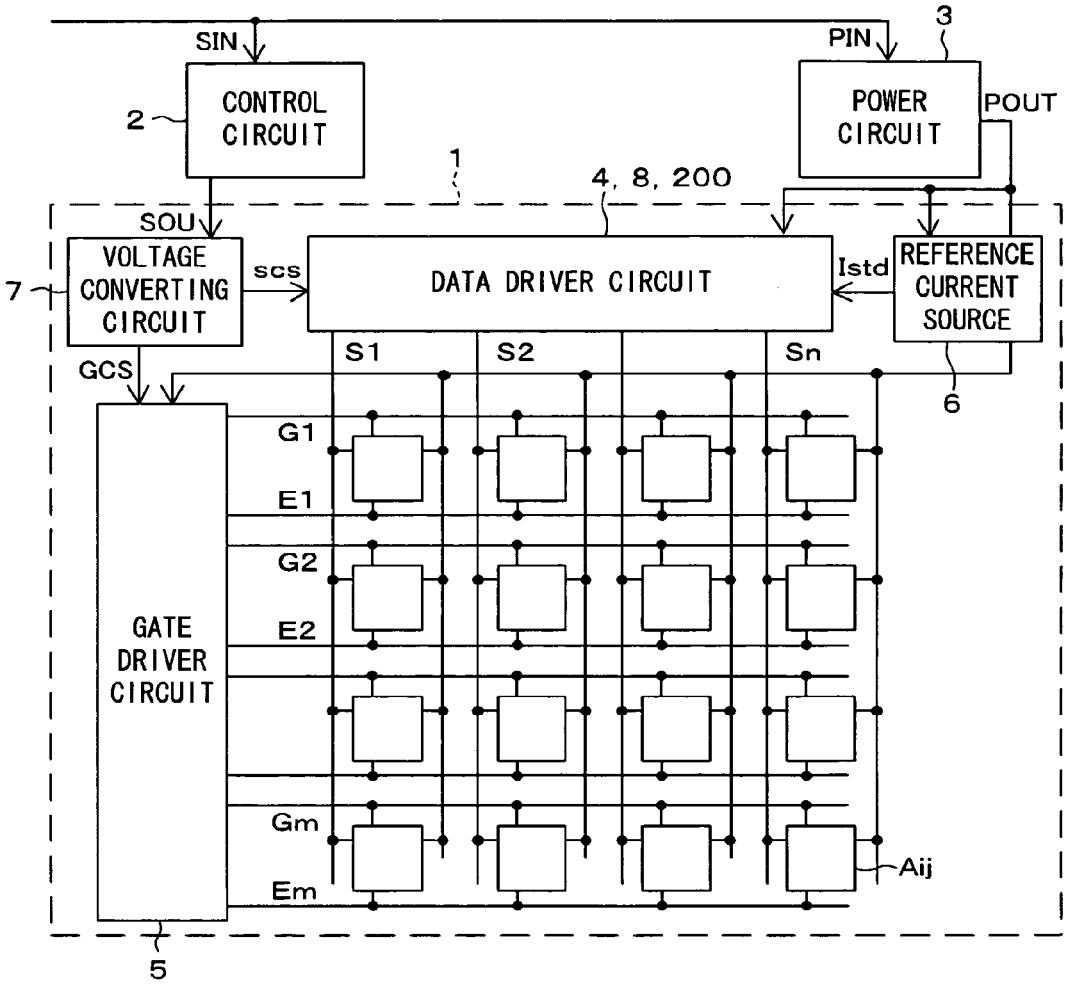
FIG. 2 is a block diagram showing a structure of the display device including the voltage/current converting circuit of FIG. 1

FIG. 2 illustrates a common structure of display devices of the First and Second Preferred Embodiments.

As shown in FIG. 2, the display device includes a display panel 1, a control circuit 2, and a power circuit 3.

The power circuit 3 is provided to supply necessary power to various components of the display panel 1. The control circuit 2 is provided to supply display data or control signals. The control circuit 2 generates command data or driving timings (see FIG. 7 and Tables 1 and 2) according to the number of pixels in the display panel 1, wherein the command data is input data to the display panel 1 as will be described later. The generated data or timing is supplied to a gate driving circuit 5 and a data driving circuit 4 (or to a data driving circuit 8 or 20 described later). For example, the control circuit 2 in a blanking scan period outputs command data or driving timing (FIG. 10, FIG. 11, FIG. 13, FIG. 15 and FIG. 17) for refreshing all of DCC circuits DC1 through DCj (described later) provided in the data driving circuit 4.

The display panel 1 includes scan lines Gi (i=1 through m) and data lines Sj (j=1 through n) which are perpendicular to each other, and pixel circuits Aij are provided in a matrix at the intersections of the scan lines and data lines. The display panel 1 further includes emission control signal lines Ei (E=1 through m) parallel to the gate lines Gi. Other components of the display panel 1 include the data driving circuit 4, the gate driving circuit 5, a reference current source 6, and a voltage converting circuit 7. The data lines Sj are connected to the data driving circuit 4. The scan lines Gi and emission control signal lines Ei are connected to the gate driving circuit 5.

For miniaturization and reduced fabrication cost of the display device, the data driving circuit 4 and the gate driving circuit 5 should preferably be provided, either partially or entirely, on the substrate of the display panel 1 where the pixel circuits Aij are provided. Alternatively, part of or all of the data driving circuit 4 and the gate driving circuit 5 may be provided as an IC on a separate substrate and externally connected to the display panel 1, even though the foregoing effect of miniaturization and reduced fabrication cost cannot be obtained in this case. For example, a chip-on-glass (COG) technique may be used in which an IC is directly bonded to a glass substrate. As another example, an IC may be formed on a flexible substrate and connected to input/output terminals provided on the substrate of the display panel 1.

The reference current source 6 is provided to supply reference current Istd to the DCC circuits DC1 through DCj (see FIG. 1) provided in the data driving circuit 4. The voltage converting circuit 5 is a circuit known as a level shifter, and it raises a power voltage for the display device to a higher voltage for use by the display panel 1.

Figure 3:
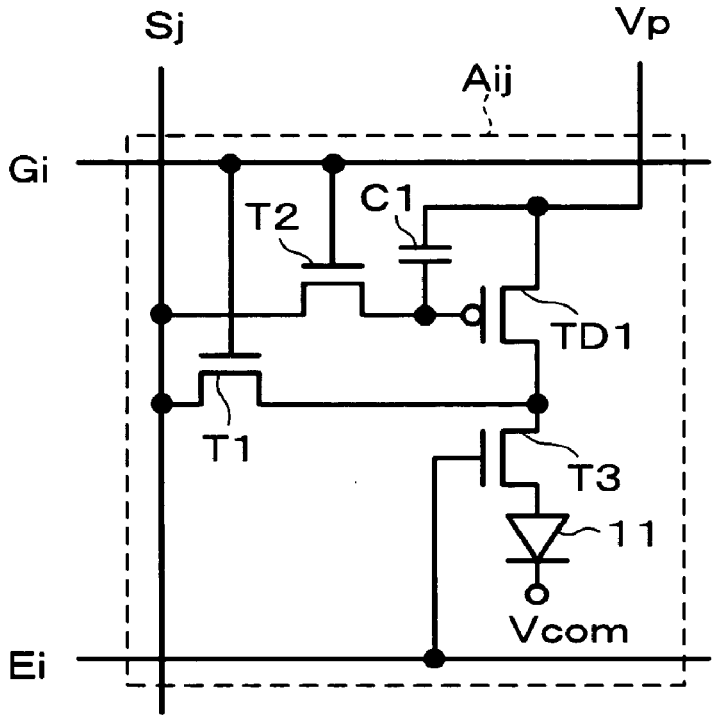
FIG. 3 is a circuit diagram showing a structure of a pixel circuit used in the display device according to the First Preferred Embodiment of the present invention.
Figure 4:
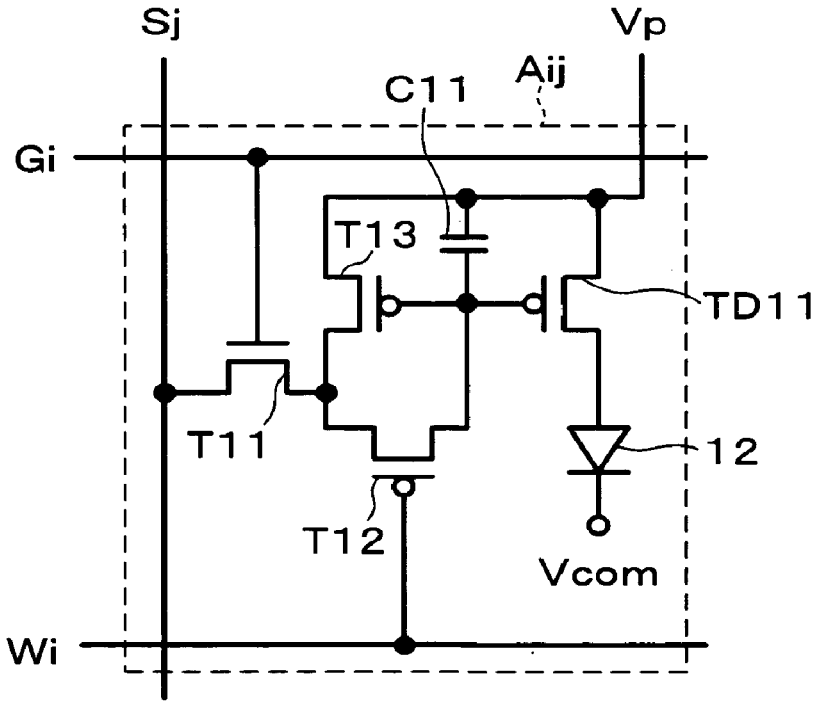
FIG. 4 is a circuit diagram showing a structure of another pixel circuit used in the display device according to the First Preferred Embodiment of the present invention.

FIG. 3 and FIG. 4 show structures of a pixel circuit Aij.

As shown in FIG. 3, the pixel circuit Aij includes an organic EL element 11, transistors T1 through T3 and TD1 (switching element), and a capacitor C1. The transistors T1 through T3 and TD1 are realized by a TFT using polycrystalline silicon or CG silicon.

The organic EL element 11 is provided as an electro-optic element near the intersection of the data line Sj and the gate line Gi, and its anode receives a common voltage Vcom. The transistor T1 is disposed between the data line Sj and the output terminal of the transistor TD1, and the gate terminal of the transistor T1 is connected to the gate line G1. The transistor T2 is disposed between the data line Sj and the capacitor C1, and the gate terminal of the transistor T2 is connected to the gate line Gi, as with the transistor T1. The transistor TD1 is connected in series to the transistor T3 between a power line Vp and the cathode of the organic EL element 11. The gate terminal of the transistor TD1 is connected to one terminal of the capacitor C1. The gate terminal of the transistor T3 is connected to the emission control signal line Ei.

Note that, the transistors T1 through T3 of the pixel circuit Aij, which are shown as an n-type TFT in FIG. 3, may be realized by a p-type TFT as long as control signals are supplied properly.

Further, the pixel circuit Aij used in preferred embodiments of the present invention may have a current mirror structure as shown in FIG. 4. The pixel circuit Aij of a current mirror structure includes an organic EL element 12 (electro-optic element), transistors T11 through T13 and TD11 realized by TFT, and a capacitor C11, wherein the transistors T13 and TD11, which are P-type TFTs, make up the current mirror. The operation of the pixel circuit Aij having such a current mirror structure is described in detail in Japanese Publication for Unexamined Patent Publication No. 147659/2001 (Tokukai 2001-147659) for example, and detailed explanation thereof is omitted here.

Generally, the output current error caused by variations of voltage-current characteristics of the TFT is greater in the current mirror structure than in the current copier structure. For this reason, the present preferred embodiment uses pixel circuits Aij of a current copier structure.

Note that, the present invention may be implemented with any structure of the pixel circuits Aij as long as it can control the current flow through the electro-optic element. Further, unlike the conventional structure in which current flows into the signal output circuit from the pixel circuit Aij when the pixel circuit Aij stores a current value, the direction of current flow may be from the signal output circuit to the pixel circuit Aij in the present invention. In the present preferred embodiment, the pixel circuits Aij are structured in the same way as the conventional example, so that the effects of the present invention can more readily be understood by a comparison with the conventional example.

Figure 5:
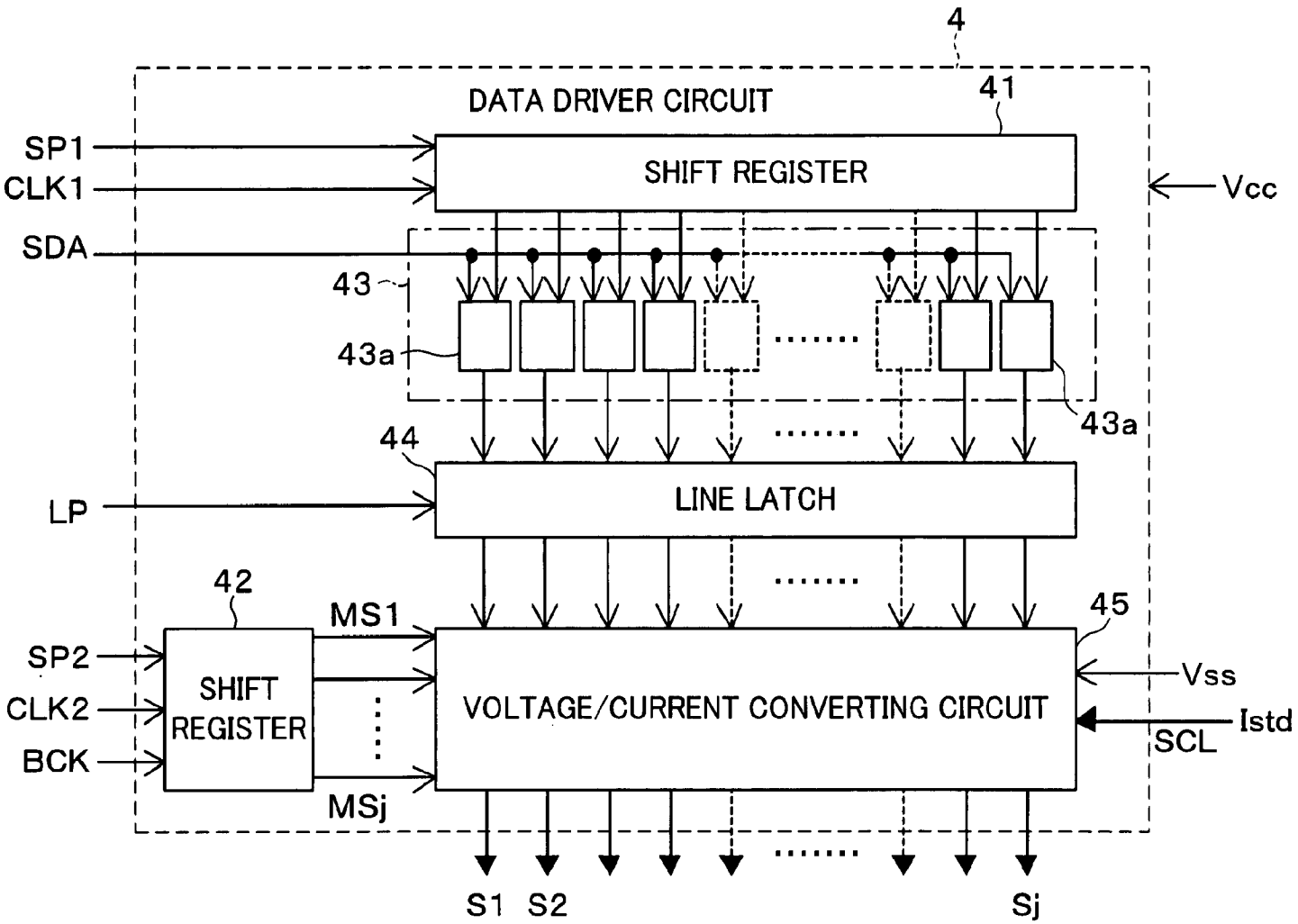
FIG. 5 is a block diagram showing a structure of the data driving circuit provided in the display device according to the First Preferred Embodiment of the present invention.

FIG. 5 illustrates a structure of the data driving circuit 4.

As shown in FIG. 5, the data driving circuit 4 includes shift registers 41 and 42, a data latch 43, a line latch 44, and a voltage/current converting circuit 45.

In the data driving circuit 4, the shift register 41 receives a start pulse SP1 from the control circuit 2, transfers it in synchronism with a clock CLK1, and outputs it as a timing signal from each of its output stages. The data latch 43 includes a plurality of flip-flops 43*a*, and latches an image data signal SDA at the timings of corresponding timing signals from the shift register 41. The image data signal SDA of one line latched in the data latch 43 is transferred by the line latch 44 to the voltage/current converting circuit 45, using a latch pulse LP.

Figure 22:
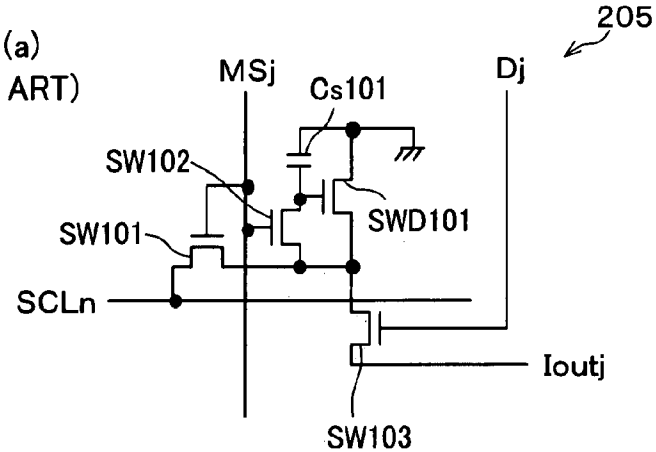
FIG. 22 (a) (PRIOR ART)
FIG. 22(*a*) through FIG. 22(*d*) are circuit diagrams showing a structure and operation of a digital/current converting circuit provided in the data driving circuit of FIG. 20.
Figure 22:
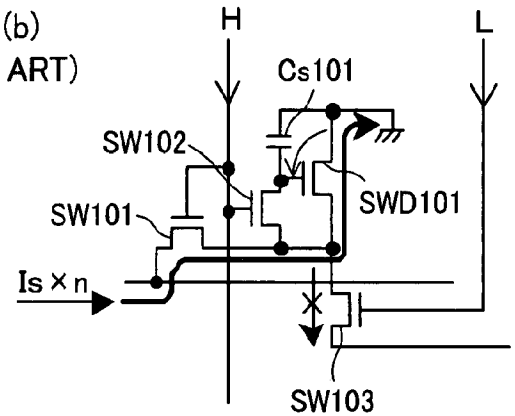
FIG. 22 (b) (PRIOR ART)
Figure 22:
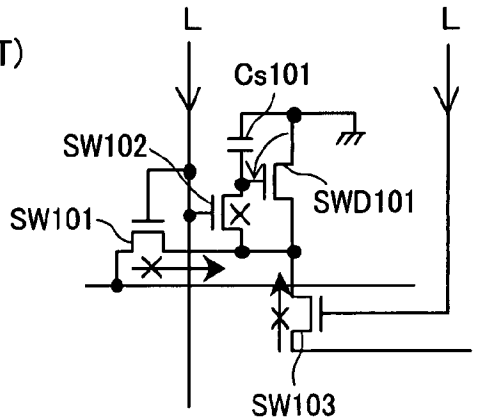
FIG. 22 (c) (PRIOR ART)
Figure 22:
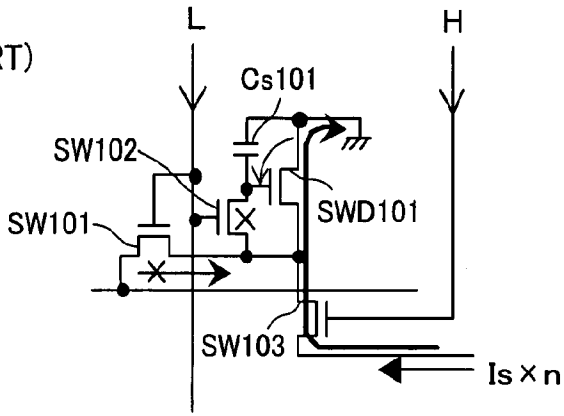
FIG. 22 (d) (PRIOR ART)

The voltage/current converting circuit 45 includes DCCs having the same circuit structure as that shown in FIG. 22(*a*) through FIG. 22(*d*). The DCC is a signal output circuit provided as the smallest unit of the voltage/current converting circuit 45, and is provided for each data line Sj. The voltage/current converting circuit 45 stores a value of the reference current Istd, and either converts the supplied data signal SDA (digital image data signal) from the line latch 44 into a signal of the stored current value, or outputs no current (a current Ioff is stored in the pixel circuits Aij). The reference current Istd is supplied to the voltage/current converting circuit 45 from the reference current source 6 through a reference current signal line SCL. Further, in the voltage/current converting circuit 45, the DCC circuits are refreshed successively with a current memory control pulse supplied from the shift register 42.

The shift register 42 transfers an input start pulse SP2 in synchronism with a clock CLK2, and adjusts a pulse width according to a blanking timing signal BCK. As a result, the shift register 42 outputs a current memory control pulse at corresponding timings in synchronism with a blanking scan period. The current memory control pulse is outputted from the respective output stages of the shift register 42 through current memory signal lines MSj. Further, the shift register 42 serves as a control circuit since it outputs the current memory control pulse at a refresh timing of the DCC circuit driven by any of the driving methods shown in FIG. 10, FIG. 11, and FIG. 13 (described later).

Figure 1:
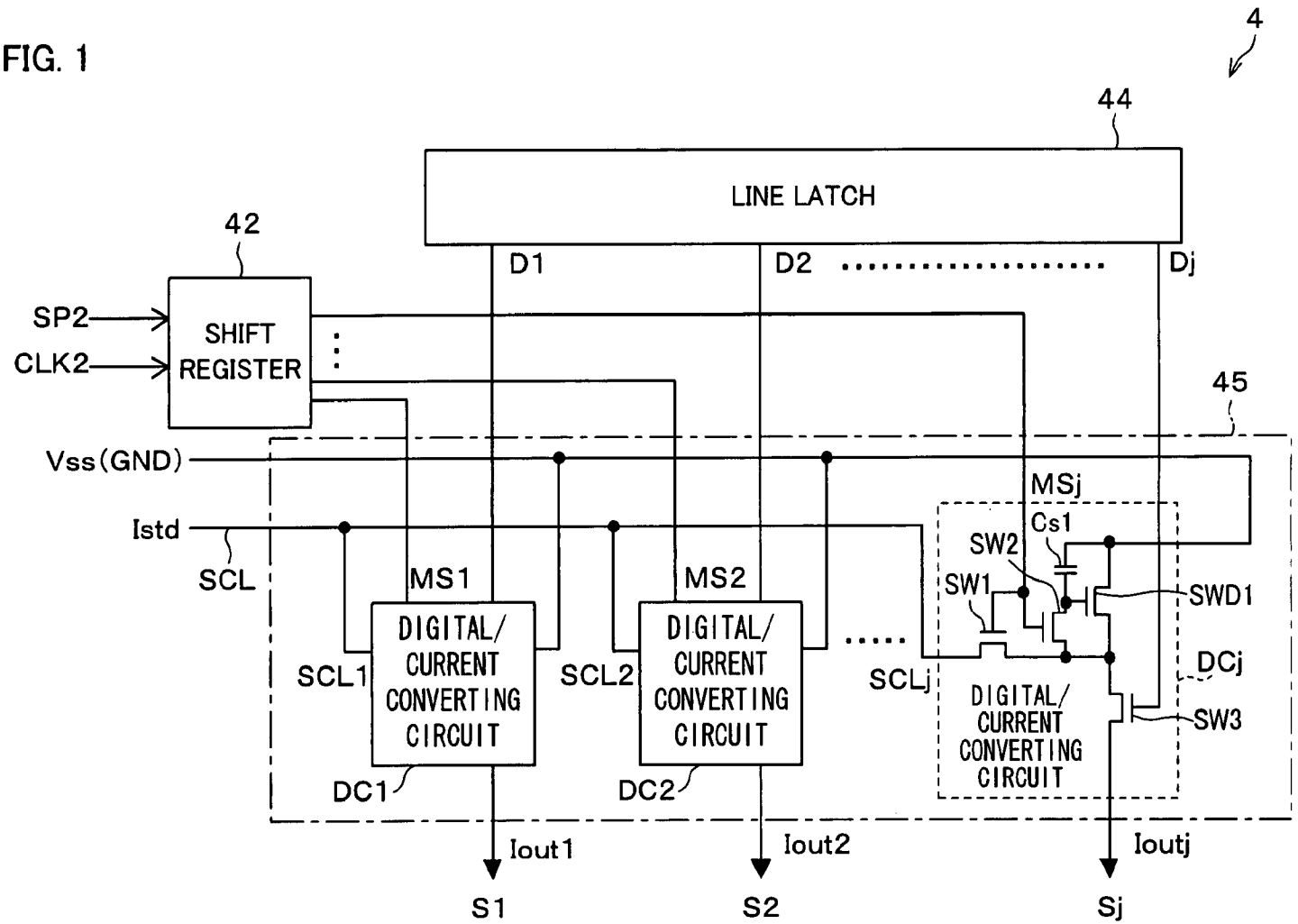
FIG. 1 is a block diagram showing a structure of a voltage/current converting circuit in a data driving circuit provided in a display device according to a First Preferred Embodiment of the present invention.

FIG. 1 illustrates a structure of the voltage/current converting circuit 45.

As shown in FIG. 1, the voltage/current converting circuit 45 includes DCC circuits DC1 through DCj of a current copier structure (signal output circuit). In the following, the term "DCC circuit DC" will be used to collectively refer to the DCC circuits DC1 through DCj. Further, the term "data line S" will be used to collectively refer to the data lines S1 through Sj. Further, the term "current memory signal line MS" will be used to collectively refer to the current memory signal lines MS1 through MSj. Further, the term "digital data output line D" will be used to collectively refer to the digital data output lines D1 through Dj.

The DCC circuits DC1 through DCj respectively have output lines Iout1 through Ioutj which are connected to the data lines S1 through Sj, respectively. Further, through reference current signal lines SCL1 through SCLj, the DCC circuits DC1 through DCj are connected in parallel to the reference current signal line SCL that flows the reference current Istd. The DCC circuits DC1 through DCj are also connected to the line latch 44 via digital data output lines D1 through Dj, respectively. Further, the DCC circuits DC1 through DCj are connected to the outputs of the shift register 42 via the current memory signal lines MSj. In this way, the DCC circuits DC1 through DCj successively receive a refresh signal from the shift register 42 within one frame period, in synchronism with a blanking scan.

The following more specifically describes a structure of the DCC circuit DC, using the DCC circuit DCj as an example. The DCC circuit DCj of a current copier structure includes switching elements SWD1 and SW1 through SW3, which are realized by TFT using polycrystalline silicon or CG silicon. The DCC circuit DCj also includes a capacitor Cs1.

The switching element SWD1 and the switching element SW3 are connected to each other in series between the data line Sj and a power line Vss (ground line GND). That is, an input terminal of the switching element SWD1 (first transistor) is connected to the power line Vss. The capacitor Cs1 is connected between the power line Vss and a gate terminal of the switching element SWD1. The switching element SW2 (second transistor) has an input terminal connected to an output terminal of the switching element SWD1. The output terminal of the switching element SW2 is connected to the gate terminal of the switching element SWD1.

The switching element SW3 has a gate terminal connected via a digital data output line Dj to the line latch 44. The switching element SW1 has an input terminal connected to the reference current signal line SCLj. The output terminal of the switching element SW1 is connected to a junction of the switching element SWD1 and the switching element SW3. The gate terminals of the switching elements SW1 and SW2 are both connected to the current memory signal line MSj.

In the DCC circuit DCj so structured, the gate voltage of the switching element SWD1 generated by a current flow (reference current) in the switching element SWD1 is held in the capacitor Cs1 under the control of a gate voltage of the switching element SW2. The voltage held in the capacitor Cs1 controls a current that flows into the switching element SWD1.

Figure 6:
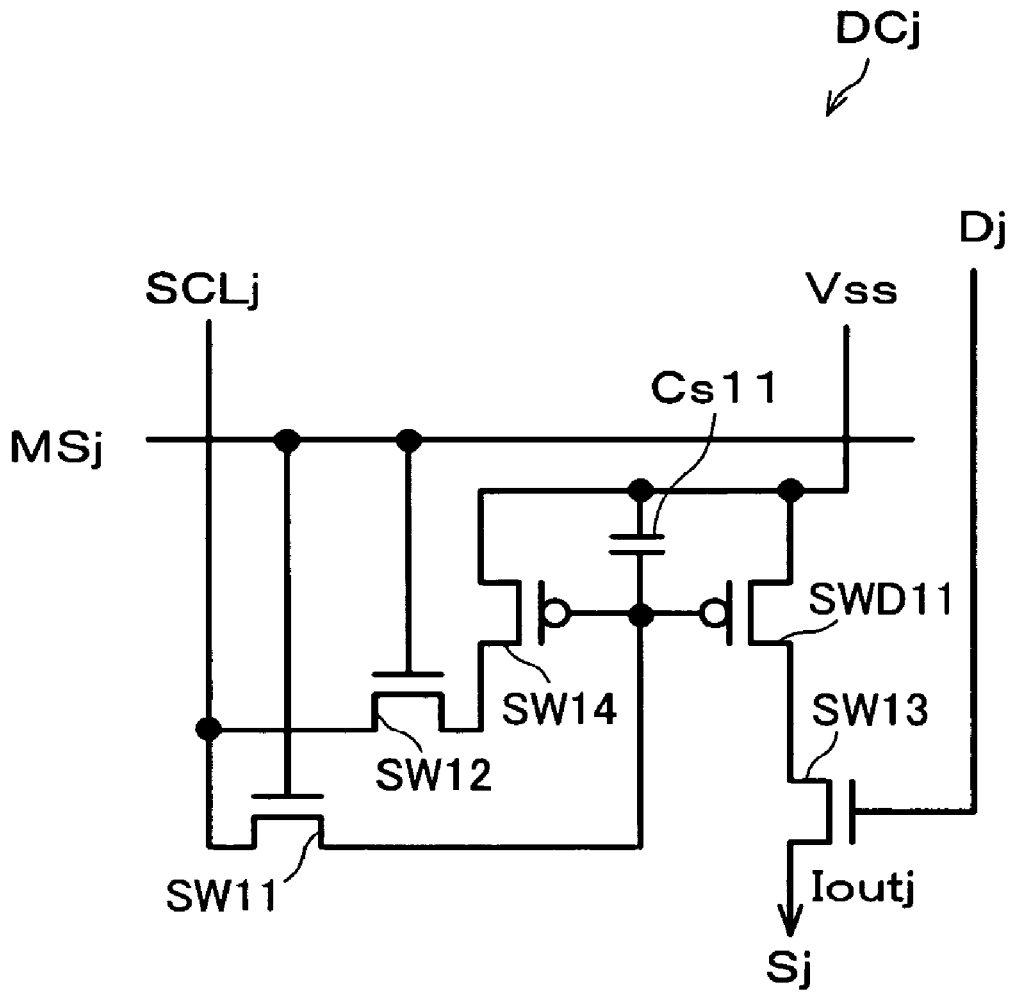
FIG. 6 is a circuit diagram showing a structure of a digital/current converting circuit of a current mirror structure used in the data driving circuit of FIG. 5.

Instead of the current copier structure, the DCC circuit DC may use the current mirror structure as described below. FIG. 6 illustrates a DCC circuit DC of a current mirror structure.

As shown in FIG. 6, the DCC circuit DC includes switching elements SWD11 and SW1 through SW14, which are realized by TFT using polycrystalline silicon or CG silicon. The DCC circuit DC also includes a capacitor Cs11.

The switching element SW14 (first transistor) and the switching element SWD11 (second transistor) are connected to each other at their gate terminals, and the input terminals of the switching element SW14 and the switching element SWD11 are both connected to a common power line Vss. The capacitor Cs11 is connected between the input terminals and gate terminals of the switching element SW14 and the switching element SWD11. As for the switching element SW12 (third transistor), one of the input and output terminals is connected to an output terminal of the switching element SW14, and the other terminal is connected to a reference current signal line SCLj.

The switching element SW13 has a gate terminal connected via a digital data output line Dj to the line latch 44. The switching element SW11 has an input terminal connected to the reference current signal line SCLj. The output terminal of the switching element SW11 is connected to the gate terminals of the switching elements SW14 and SWD11. The gate terminal of the switching element SW12 is connected to the current memory signal line MSj.

In the DCC circuit DC so structured, a voltage according to a flown current (reference current) through the switching element SW14 is held in the capacitor Cs11 under the control of a gate voltage of the switching element SW12. Further, in the DCC circuit DC, the stored voltage produces a current of the same level for the switching element SWD11 as for the switching element SW14.

The current storing operation of the DCC circuit DC is different from that having the current copier structure. However, the output result of the output line Ioutj obtained in response to the input signals supplied through the digital data output line Dj or current memory signal line MSj is the same. As such, no further explanation will be given for the operation of the DCC circuit DC.

As in the case of the structure of the pixel circuit Aij, the current copier structure is known to produce more accurate output current. Accordingly, the present preferred embodiment will be described through the case where the DCC circuit DC uses the more preferable current copier structure.

With the described structure, the display device uses a time-division gradation driving method with a blanking scan period but without an initializing TFT, and is driven by a driving method in which (a) the signal transmission that uses a blanking scan to send the image data signal from the DCC circuit DC to the pixel circuits Aij and (b) resetting (refreshing) of an output value of the DCC circuit DC are successively carried out within one frame period.

Further, in the present preferred embodiment, the electro-optic element has only two states: ON state (emission) and OFF state (non-emission), wherein the reference current Istd flows into the electro-optic element in an ON state, and the OFF current Ioff flows into the electro-optic element in an OFF state. Accordingly, the DCC circuit DC used in the data driving circuit 4 is preferably a 1-bit type in which a digital signal data indicative of these two states is converted into two current values. Specifically, the DCC circuit DC is realized by a 1-bit converting circuit that includes a DCC circuit DC of a current copier structure for each data line S, as shown in FIG. 1.

In the following, description is made as to the time-division gradation driving method that realizes 6-bit gradation display in the display device of the present preferred embodiment. With the time-division gradation driving method, the control circuit 2 generates $\alpha$ command data (here, $\alpha$=8) including a blanking signal, based on an input image data signal for 6-bit gradation display. Further, for 6-bit gradation display, the driving method changes a display state of each pixel circuit Aij 8 times within one frame period, and an ON signal (reference current Istd) or an OFF signal (OFF current Ioff) is supplied to the data line S in each of the $\alpha$ periods (select periods) so as to display either ON state or OFF state of the electro-optic element.

Further, the driving method uses 8 command data with a weight ratio of 1:2:4:7:14:14:21:0 for the bit numbers 1, 2, 3, 4, 5, 6, 7, and B (where B is a blanking signal corresponding to a bit with no weight). These bit numbers are displayed in each pixel circuit Aij in the order of 7, 6, 1, 2, 3, 4, 5, and B.

Figure 7:
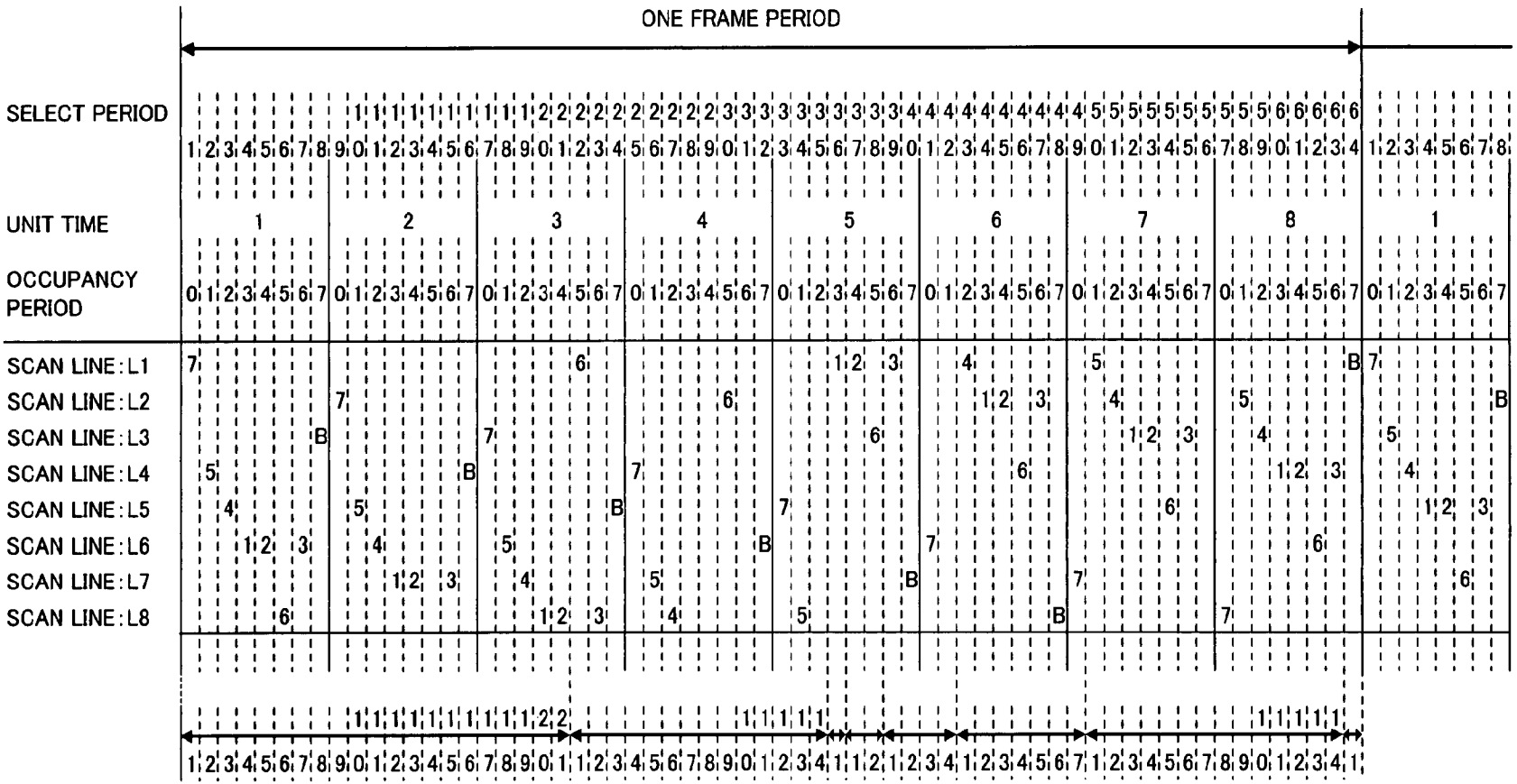
FIG. 7 is a driving timing chart according to a driving method used in the display device according to the First Preferred Embodiment of the present invention.

FIG. 7 is a scan sequence diagram based on this setting, representing select timings for each of 8 scan lines. In the scan sequence diagram, the horizontal axis represents time, and the vertical axis represents scan lines L1 through L8. On the time axis, one frame period represents select periods, and a unit time represents 8 select periods. The 8 select periods of each unit time are individually represented by occupancy periods. A select timing for each scan line is indicated by any of the bit numbers 1 through 7 and B in the column of the scan lines L1 through L8. Pixel circuits Aij corresponding to each scan line Li are selected at a timing indicated by the bit number, and an image data signal of the corresponding bit number is sent.

Taking the scan line L1 for example, bit numbers 7, 6, 1, 2, 3, 4, 5, and B are displayed in select periods 1, 22, 36, 37, 39, 43, 50, and 64, respectively. In the subsequent scan lines L2 through L8, the timings for the scan line L1 are delayed successively by 8 select periods.

As a result, the bit numbers 7, 6, 1, 2, 3, 4, 5, and B are displayed in this order for the duration of 21, 14, 1, 2, 4, 7, 14, and 0 display periods, respectively corresponding to their weights.

In this manner, when the number of display bits is 8 and the number of scan lines is 8, one frame period includes 64 select periods. This allows for driving timings that require only one select period for the blanking in which the bit number B is displayed. Further, the driving ensures that any of the bit numbers for a given scan line is always selected, and that all the select periods are used.

Table 1 below summarizes information concerning bit numbers, bit weights, the position of occupancy periods occupied by the bit number, the number of necessary select periods for the display, the number of scan lines in the display panel 1, the number of bits, and the number of select periods in one frame period.

TABLE 1

| | bit number | bit weight | Occupancy period number 0 | 1 | 2 | 3 | 4 | 5 | 6 | 7 |
|---|---|---|---|---|---|---|---|---|---|---|
| 21 | 7 | 21 | • | | | | | | | |
| 14 | 6 | 14 | | | | | | • | | |
| 1 | 1 | 1 | | | | • | | | | |
| 2 | 2 | 2 | | | | | • | | | |
| 4 | 3 | 4 | | | | | | | • | |
| 7 | 4 | 7 | | | • | | | | | |
| 14 | 5 | 14 | | • | | | | | | |
| 0 | B | 0 | | | | | | | | • |
| | Total | 63 | | | | | | | | |

| The number of scan lines | The number of bits | Scan period | ON period | Difference | ON ratio |
|---|---|---|---|---|---|
| 8 | 8 | 64 | 63 | 1 | 98.44% |

In Table 1, for example, the filled circle for the bit number 7 indicates that the bit number 7, which is displayed first, occupies the occupancy period 0. For the next bit number 6, the filled circle indicates that the bit number 6 occupies the occupancy period 5, which is on the fifth position relative to the occupancy period 0, wherein the occupancy position 5 is determined by the reminder 5 of the division of the weight 21 of the bit number 7 by the bit number 8. Similarly, for the next bit number 1, the filled circle indicates that the bit number 1 occupies the occupancy position 3, which is on the sixth position relative to the occupancy period 5, wherein the occupancy period 3 is determined by the reminder 6 of the division of the weight 14 of the bit number 6 by the bit number 8. In this manner, the driving method sets an occupancy period for the next bit based on the reminder of the division of each bit weight by the bit number 8, as can be seen from the table.

With 8 command data (bit numbers 1 through 7 and B), the driving method used in the present preferred embodiment generate timings by determining the order and weight of the bit numbers such that all of the occupancy periods 0 through 7 are used once.

According to this format, Table 2 below shows timings for carrying out 64 gradation display when 220 scan lines are provided. Here, the display period for the smallest bit has 27 select periods, and accordingly the ON period includes 27×63=1701 select periods. In this case, a proportion of the ON period in one frame period (220×8=1760 select periods) is 96.65%.

TABLE 2

| | bit number | bit weight | Occupancy period number 0 | 1 | 2 | 3 | 4 | 5 | 6 | 7 |
|---|---|---|---|---|---|---|---|---|---|---|
| 21 | 7 | 567 | • | | | | | | | |
| 14 | 6 | 378 | | | | | | | | • |
| 1 | 1 | 27 | | • | | | | | | |
| 2 | 2 | 54 | | | | | • | | | |
| 4 | 3 | 108 | | | • | | | | | |
| 7 | 4 | 189 | | | | | | | • | |
| 14 | 5 | 0 | | | | • | | | | |
| 0 | B | 0 | | | | | | | | • |
| | Total | 63 | | | | | | | | |

| The number of scan lines | The number of bits | Scan period | ON period | Difference | ON ratio |
|---|---|---|---|---|---|
| 220 | 8 | 1760 | 1701 | 59 | 96.65% |

The bit weights (particularly upper bits) used in the driving method do not differ greatly from one another (ranging from 14 to 21 for example). However, this does not pose a problem in the operation of the display device. On the contrary, it is actually desirable to prevent dynamic false contour.

Figure 8:
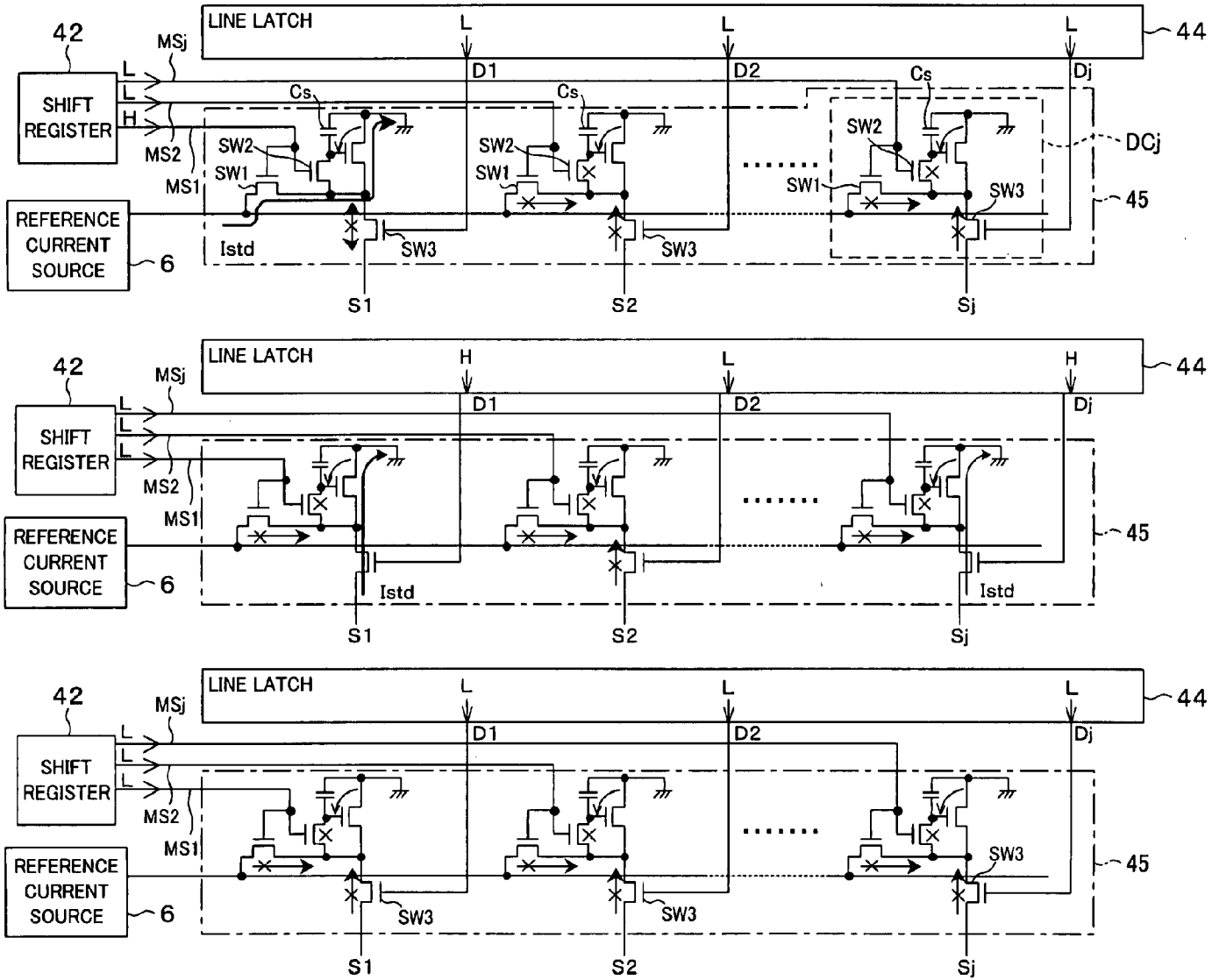
FIG. 8(*a*) through FIG. 8(*c*) are explanatory views showing operations of a digital/current converting circuit using the driving method of FIG. 7.

FIG. 8(*a*) through FIG. 8(*c*) concerns the driving method with a blanking scan, showing operations of the DCC circuits DC in writing current (refreshing), sending data to the pixels, and a blanking scan period.

In a state shown in FIG. 8(*a*), the DCC circuits DC are successively refreshed according to the current memory control pulse supplied from the shift register 42. In this state, each DCC circuit DC receives the reference current Istd from the reference current source 6 through the reference current signal line SCL. Further, since the outputs of the line latch 44, i.e., the potentials of the digital data output lines Dj are all at low level (L), the switching element SW3 of the DCC circuit DC is turned off. As a result, no current is outputted from the DCC circuit DC to the data line S.

In this state, when the shift register 42 outputs a current memory control pulse of a high level (H) successively to the DCC circuits DC through the current memory signal lines MS, the current value of the reference current Istd is stored in the capacitor Cs of each DCC circuit DC. This prevents the switching elements SW1 and SW2 from being turned on simultaneously in a plurality of DCC circuits DC. In the state shown in FIG. 8(*a*), a High (H) level current memory control pulse is supplied to the DCC circuit DC1.

FIG. 8(*b*) shows a data transmission period for the pixel circuits Aij. In this state, the potential level of each digital data output line D corresponding to the digital image data that has been transferred to the line latch 44 is set to either high (H) level or low (L) level. As a result, the reference current Istd that turns on the electro-optic element is supplied to the data line S, or no current is supplied. With no current, the pixel circuit Aij stores the OFF current Ioff that creates an OFF state.

FIG. 8(*c*) shows a blanking scan period (set period). In this state, an OFF signal needs to be supplied to all the pixel circuits Aij on the scan line Gi selected in this scan period (an OFF state (specific display state) is created for the pixel circuits Aij), regardless of the DCC circuits DC. Thus, in the state shown in FIG. 8(*c*), the switching element SW3 needs to be turned off in all the DCC circuits DC. Accordingly, the potential levels of the digital data output lines Dj of the line latch 44 are all at low (L) level. This is equivalent to the DCC circuits DC carrying out refreshing (state shown in FIG. 8(*a*)), meaning that one of the DCC circuits DC connected in parallel is available to store a current value. Thus, in a blanking scan period, the DCC circuits DC can refresh under the control of the line latch 44, as shown in FIG. 8(*a*).

Note that, when the switching element SW3 is OFF, the data line S is disconnected from the data driving circuit 4 and the potential of the data line S becomes unstable.

If a current value is supplied to the pixel circuits Aij in this state, some of the pixel circuits Aij may fail to obtain an OFF state as intended, depending on the potential of the data line S. In this case, a structure shown in FIG. 9 may be used.

Figure 9:
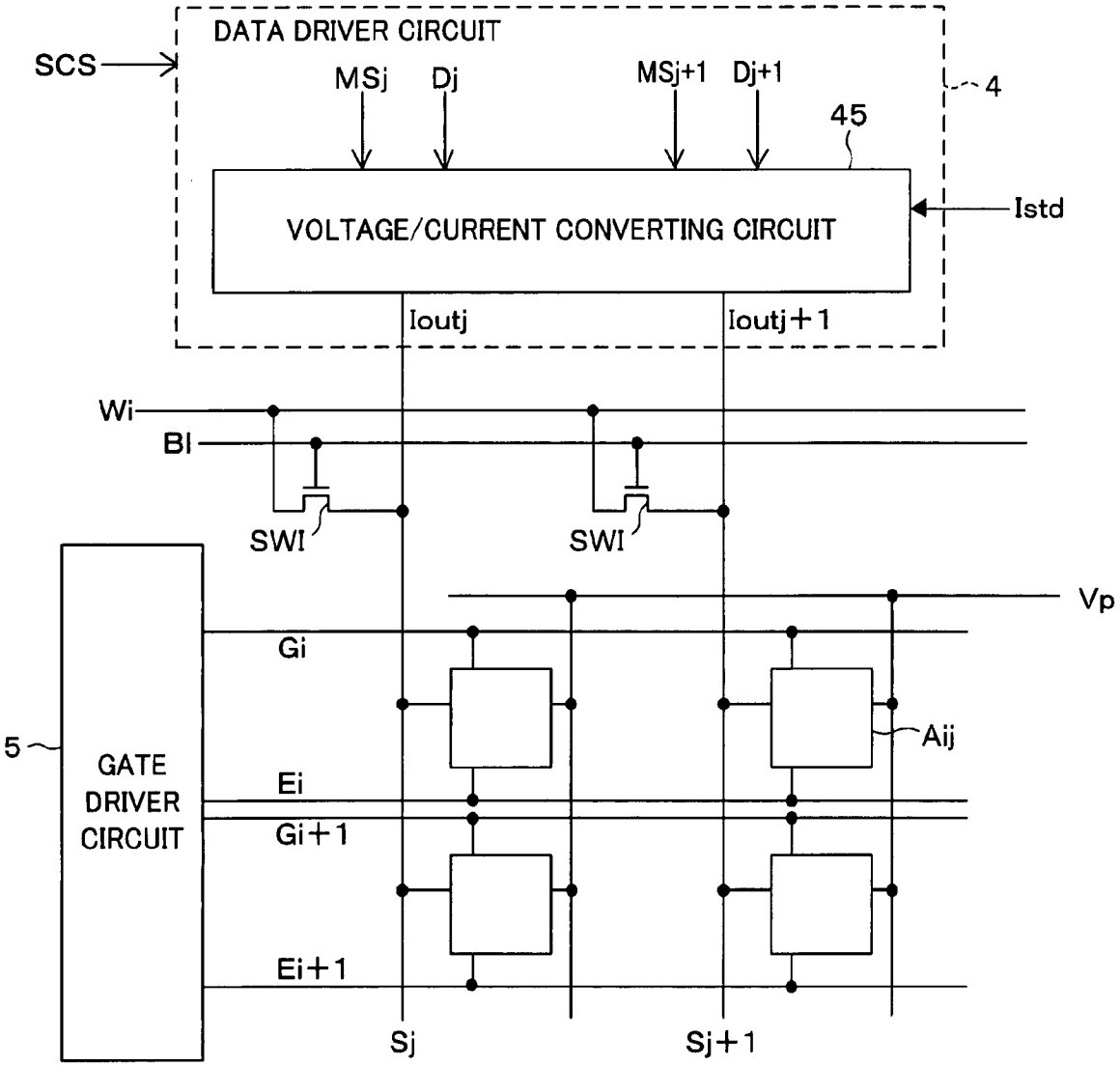
FIG. 9 is a block diagram showing a structure in which a circuit for applying a blanking signal has been added in the display device according to the First Preferred Embodiment of the present invention.

FIG. 9 shows a display device structure that ensures that an initial value is applied in a blanking period without fail. A display device shown in FIG. 9 is a modification of the display device shown in FIG. 2, in that it additionally includes a switching element SW1 and a signal line B1 on the data line S disposed between the voltage/current converting circuit 45 and the pixel circuits Aij. The signal line B1 is provided to control ON/OFF of the switching element SW1. Further, an initializing line Wi for applying initializing data is connected to the data line S via the switching element SW1. With this structure, it is ensured in the blanking scan period that the OFF current Ioff that creates an OFF state successfully flows into the pixel circuits Aij through the initializing line Wi.

In the following, description is made as to the writing operation of the display device.

When a scan line is addressed for a blanking scan, the digital image data signal data which the line latch 44 of the data driving circuit 4 outputs to the voltage/current converting circuit 45 are all at low (L) level. That is, an OFF-state voltage is applied to the switching element SW3 of the DCC circuit DC.

Thus, no image data signal is supplied and there accordingly will be no emission, even when a scan line Gp is selected and all the pixel circuits Aij connected to the scan line Gp are addressed.

As for the DCC circuits DC, all of the DCC circuits DC are available to store current values. However, the current memory control pulse is applied only to the current memory signal line MSj (where j takes an arbitrary value), and only the DCC circuit DCj stores a current value. The other DCC circuits DC cannot store current values because no current memory control pulse is applied through the current memory signal lines MS.

The command data are recurrently selected in unit times according to the bit numbers 7, 6, 1, 2, 3, 4, 5, and B. Thus, a scan line Gq is selected for a blanking scan after the scan line Gp and subsequent six scan lines have been selected. Here, the data driving circuit 4, and the pixel circuits Aij connected to the scan line Gq operate in the same manner as in the immediately preceding blanking scan for the scan line Gp. However, because the shift register 42 supplies the next current memory control pulse to the current memory signal line MSj+1, the DCC circuit DC that is refreshed by the blanking scan on the scan line Gq is the DCC circuit DCj+1 on the next stage of the DCC circuit DCj.

By repeating this procedure, in the nth blanking relative to the first blanking scan for the scan line Gp, the shift register 42 outputs the current memory control pulse to the current memory signal line MSj+n, and the DCC circuit DCj+n is refreshed.

With the foregoing structure, the DCC circuits DC are successively refreshed one at a time in every blanking scan.

The following describes the writing operation of the pixel circuit Aij in the display device of the present preferred embodiment.

In the pixel circuit Aij shown in FIG. 3, the scan line Gi is selected, the emission control signal line Ei is not selected, and the switching element SW3 of the DCC circuit DCj connected to the data line Sj is turned on. In this state, the current Istd of a constant level stored in the DCC circuit DCj is caused to flow through the power line Vp, the switching elements TD1 and T1, and the switching elements SW3 and SWD1 of the DCC circuit DCj. Here, in the pixel circuit Aij, the switching element T2 is also turned on, charging the capacitor C1 to the potential sufficient for the switching element TD1 to flow the current Istd.

When the scan line Gi and the emission control signal line Ei are not selected, the switching elements T1 and T2 are turned off. The capacitor C1 then holds the potential sufficient for the switching element TD1 to flow the reference current Istd. When the scan line Gi is not selected and the emission control signal line Ei is selected, a current flows into the organic EL element 11 through the power line Vp and the switching elements TD1 and T3. Here, the capacitor C1 of the pixel circuit Aij holds the gate-source potential of the switching element TD1 at the potential that flows the reference current Istd. This allows a constant current to flow even when the voltage-current characteristics of the organic EL element 11 vary.

Incidentally, concerning the refreshing of the DCC circuits DC of the current copier structure as shown in FIG. 1, Publication (3) discusses the charge time of the capacitor Cs1 that stores a current value of the current generated by holding the gate-source voltage of the switching element SWD1.

Generally, when a current value is set for the DCC circuit DC to charge the capacitor Cs1, more charge time is required for smaller current values. For example, in order for the organic EL element 11 of the pixel circuit Aij to emit its pre-set maximum luminance, a current value of 10 μA is required. Further, when the minimum current value for carrying out 6-bit gradation display in an analog driving mode is approximately 10/64 μA (minimum luminance), the time required to charge the capacitor Cs1 to a predetermined voltage is not more than about 1 microsecond for the current value of 10 μA, and is at most about 5 microseconds for the current of approximately 10/64 μA.

In a digital driving mode, the current supplied to the pixel circuits Aij is generally set to a value that produces an estimated maximum luminance as determined by the designing of the display device. In the analog driving mode, the current value that produces the minimum luminance needs to be stored. Therefore, in refreshing the DCC circuit DC in a blanking scan period, the digital driving mode requires a horizontal period that is equal to or greater than the required time period for applying the current of 10 μA.

It is assumed here that the display device using the foregoing driving method has a display quality of the QCIF (Quarter Common Intermediate Format) class (176 data lines×220 scan lines), and a frame frequency of 60 Hz. In this case, when the display device is driven by the time-division display mode with the 8-bit command data, one horizontal period is about 1/(60×220×8)=9.6 microseconds.

All of or part of the one horizontal period is used to select the scan line Gi, and the data driving circuit 4 applies the image data signal to the pixel circuit Aij. Thus, in the display device of the QCIF class using the foregoing driving method, the image data signal based on any command data needs to be outputted from the DCC circuit DC within at least about 9.6 microseconds. As such, the blanking scan period cannot exceed approximately 9.6 microseconds.

By comparing the blanking time period and the refresh time for the DCC circuit DC, it can be seen that the blanking time period is long enough to accommodate the refresh therein. Thus, by refreshing the DCC circuit DC one at a time in every blanking scan, refreshing can be carried out 220 times—the same number as the number of scan lines—within one frame period. Since the number of data lines is 176, all the DCC circuits DC of the data driving circuit 4 can be refreshed.

Figure 10:
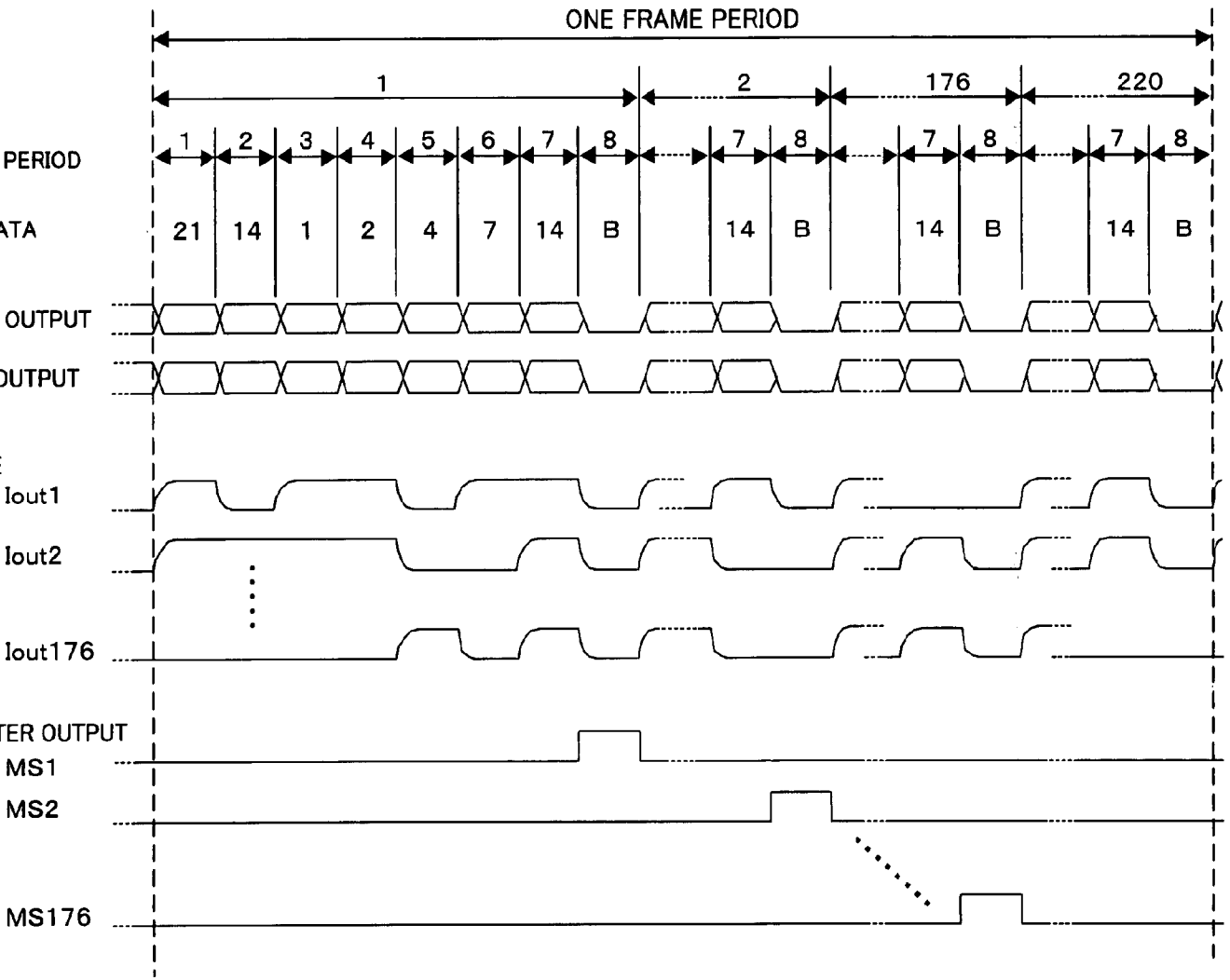
FIG. 10 is a timing chart showing an operation of the display device according to the First Preferred Embodiment of the present invention.

FIG. 10 is a driving timing chart for the display device of the QCIF class using the described driving method.

In FIG. 10, the horizontal axis represents time. The labels "unit time" and "occupancy period" on the vertical axis are as described in FIG. 7. The "command data" on the vertical axis indicates types of command data supplied to a selected scan line G in the respective occupancy periods. The "line latch output" on the vertical axis indicates a state in which the outputs of the data latch 43 are transferred to the line latch 44 and are outputted to the voltage/current converting circuits 45. The "output line" on the vertical axis indicates a state of output currents that are outputted from the DCC circuits DC to the output lines Iout1 through Iout176 according to the line latch outputs. The "shift register output" on the vertical axis indicates a state of current memory control pulses outputted to the current memory signal lines MS1 through MS176 to initiate refresh of the DCC circuits DC.

Referring to FIG. 10, the line latch output according to the image data is either high potential or low potential in any of the occupancy periods 1 through 7. On the other hand, the line latch output is always low potential in the occupancy period 8, because a blanking scan is carried out for the command data B in the occupancy period 8. Thus, in the occupancy periods 1 through 7, the DCC circuits DC output either an ON signal or OFF signal to the output lines Iout1 through Iout176, whereas the DCC circuit DC outputs an OFF signal to the output lines Iout1 through Iout176 in the occupancy period 8.

The display device using the foregoing driving method has 220 scan lines G1 through G220, and 176 DCC circuits DC1 through DC176. Thus, the shift register 42 outputs the current memory control pulse to the DCC circuits DC at such timings that the DCC circuits DC are successively refreshed one at a time in synchronism with the occupancy period 8 of the unit times 1 through 176. In the remaining unit times 177 through 220, the DCC circuits DC are not refreshed, and the current memory control pulse is supplied to the current memory signal line MS1 after one frame period, starting again from the occupancy period 8 of the unit time 1.

When the refresh of the DCC circuits DC and the output of the image data signal are made in succession within one frame period using the driving method of the present preferred embodiment as above, the DCC circuits DC are refreshed in the manner described below when the display device has a greater number of scan lines than the number of DCC circuits DC (data lines). Specifically, the shift register 42 generates timings at which the DCC circuits DC are successively refreshed one at a time in every blanking scan, and outputs the timings to the respective DCC circuits DC. This enables all the DCC circuits DC to be refreshed in one frame period, even when the DCC circuits DC are provided one for each data line S.

When there is only one DCC circuit DC is provided (b=1, where b represents the number of DCC circuits DC), the current value for the DCC circuit DC needs to be reset within one frame period when the number of data lines is smaller than the number of scan lines. On the other hand, the current value for the DCC circuit DC needs to be reset over a plurality of frame periods when the number of data lines is greater than the number of scan lines. It is difficult to realize such a b=1 configuration when the driving circuit is designed such that the hold period of the current value cannot be made sufficiently longer than one frame period. However, the DCC circuits DC only need to be provided one for each circuit that generates a timing for resetting the current value for the DCC circuits DC. Thus, provided that a sufficiently long hold period is provided for holding the current value of the DCC circuit DC, preferred embodiments of the present invention can use the b=1 configuration and be implemented with a relatively small circuit for resetting the current value of the DCC circuits DC.

For example, when the display device using the foregoing driving method has a display quality VGA (640 (the number of data lines)×480 (the number of scan lines)), and a frame frequency of 60 Hz, the display device is driven by the time-division display method using the 8-bit command data. In this case, one horizontal period is about 1/(60×480×8)=4.3 microseconds.

All of or part of the one horizontal period is used to select a scan line G, and the data driving circuit 4 applies the image data signal to the pixel circuit Aij. Thus, in the display device of the VGA class using the foregoing driving method, any command data needs to be outputted from the DCC circuit DC within at least about 4.3 microseconds. As such, the blanking scan period cannot exceed approximately 4.3 microseconds.

It is assumed here that the display device of the VGA class has 640 data lines (n). Accordingly, the same number of DCC circuits DC is required. However, as described above, the blanking scan is carried out only 480 times within one frame period—the same as the number of scan lines (m).

By comparing the time H of one horizontal period and the time T required for the refresh, it can be seen that time H is greater than time T (H>T, H≧bT), meaning that at least two DCC circuits DC are sufficient to carry out the refresh. Thus, by adjusting the output timings of the shift register 42, the DCC circuits DC are successively refreshed for each b DCC circuits DC (where b is an integer of not less than 2, here b=2) in every blanking scan. In this way, at most 480(m)×2(b)=960 (n) DCC circuits DC can be refreshed within a whole one frame period. That is, m≧n/b is established.

Figure 11:
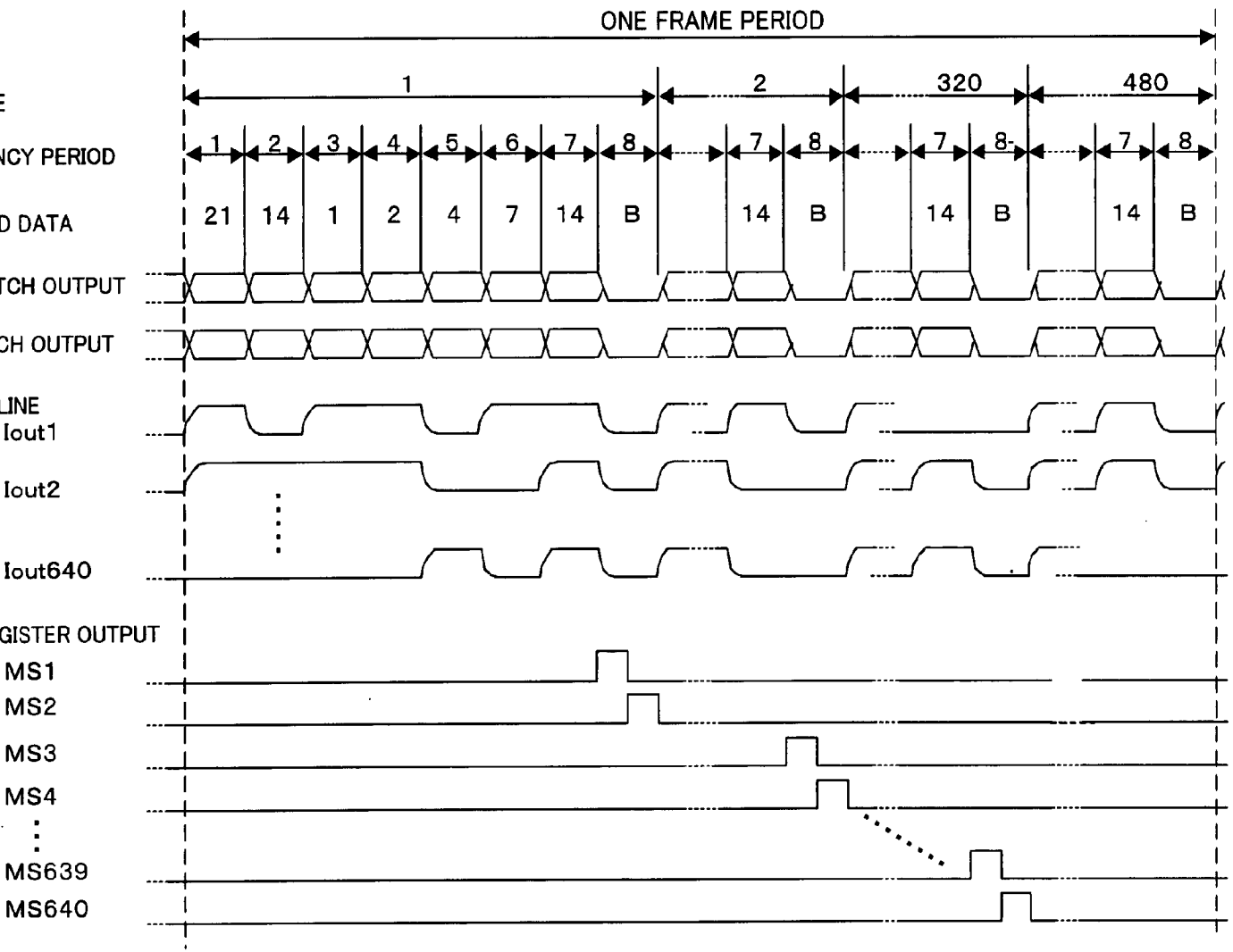
FIG. 11 is a timing chart showing an operation of a different type of display device according to the First Preferred Embodiment of the present invention.

FIG. 11 is a timing chart representing the operation of the VGA class display device using the foregoing driving method.

As with FIG. 10, FIG. 11 shows how the unit time and occupancy period relate to various output states such as the data latch output, line latch output, and shift register output. FIG. 11 differs from FIG. 10 in that there are 480 unit times, owning to the fact that the display panel 1 is VGA. Another difference from FIG. 11 is that 640 DCC circuits DC are provided according to the 640 data lines.

Here, the display device operates such that the shift register 42 successively refreshes the DCC circuits DC1 and DC2 in the occupancy period 8 in unit time 1, i.e., in the blanking scan period of unit time 1. More specifically, the occupancy period 8 is divided into two periods, and the current memory control pulse is supplied to the current memory signal line MS1 in the first half, and to the current memory signal line MS2 in the second half.

Then, as in FIG. 10, the current memory control pulse is sent to the current memory signal lines MS3 and MS4 in the occupancy period 8 in unit time 2. By repeating this procedure, all the 640 DCC circuits DC are refreshed at the end of unit time 320.

In refreshing the DCC circuits DC and outputting the image data signal in succession within one frame period using the driving method of the present preferred embodiment as above, a plurality of DCC circuits DC can be refreshed within one blanking scan period. In this way, the data driving circuit 4 can be realized with the DCC circuits DC provided one for each data line, even when the data lines S exceed the scan lines G in number, i.e., in the display device with a large number of DCC circuits DC. This enables the data driving circuit 4 to be reduced in scale compared with the conventional examples where two DCC circuits DC are required for each data line.

Note that, the conventional examples use the 6-bit analog driving mode, which corresponds to the 1-bit DCC realized as the DCC circuit DC in the present preferred embodiment using the digital driving mode.

Figure 19:
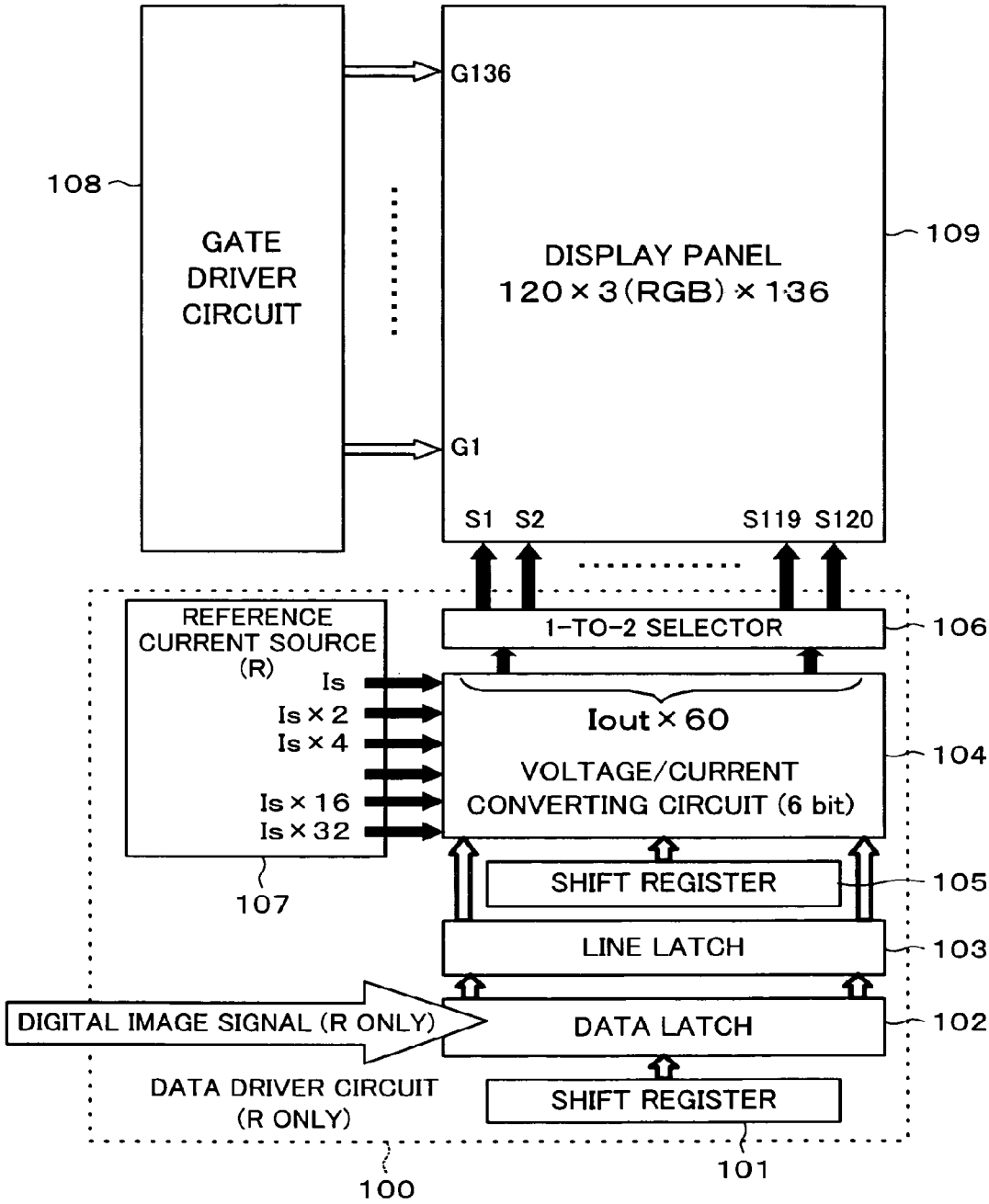
FIG. 19 (PRIOR ART)
FIG. 19 is a block diagram showing a structure of a conventional current-controlled display device.

Further, the conventional examples require the A/B selector 204 (see FIG. 19) because a pair of DCC circuits DC is connected to each data line S. The present preferred embodiment, on the other hand, does not require the A/B selector A/B because only a single DCC circuit DC is connected to each data line S. In addition, because the number of DCC circuits DC is reduced in half as compared to the conventional examples, the data driving circuit 4 can be realized at the same scale without using the 1-to-2 selector 106. That is, the data driving circuit 4 can be realized without requiring the two kinds of selectors while maintaining the circuit scale of the conventional DCC circuits DC or other circuits. This enables the size and power consumption of the display device to be reduced.

Figure 12:
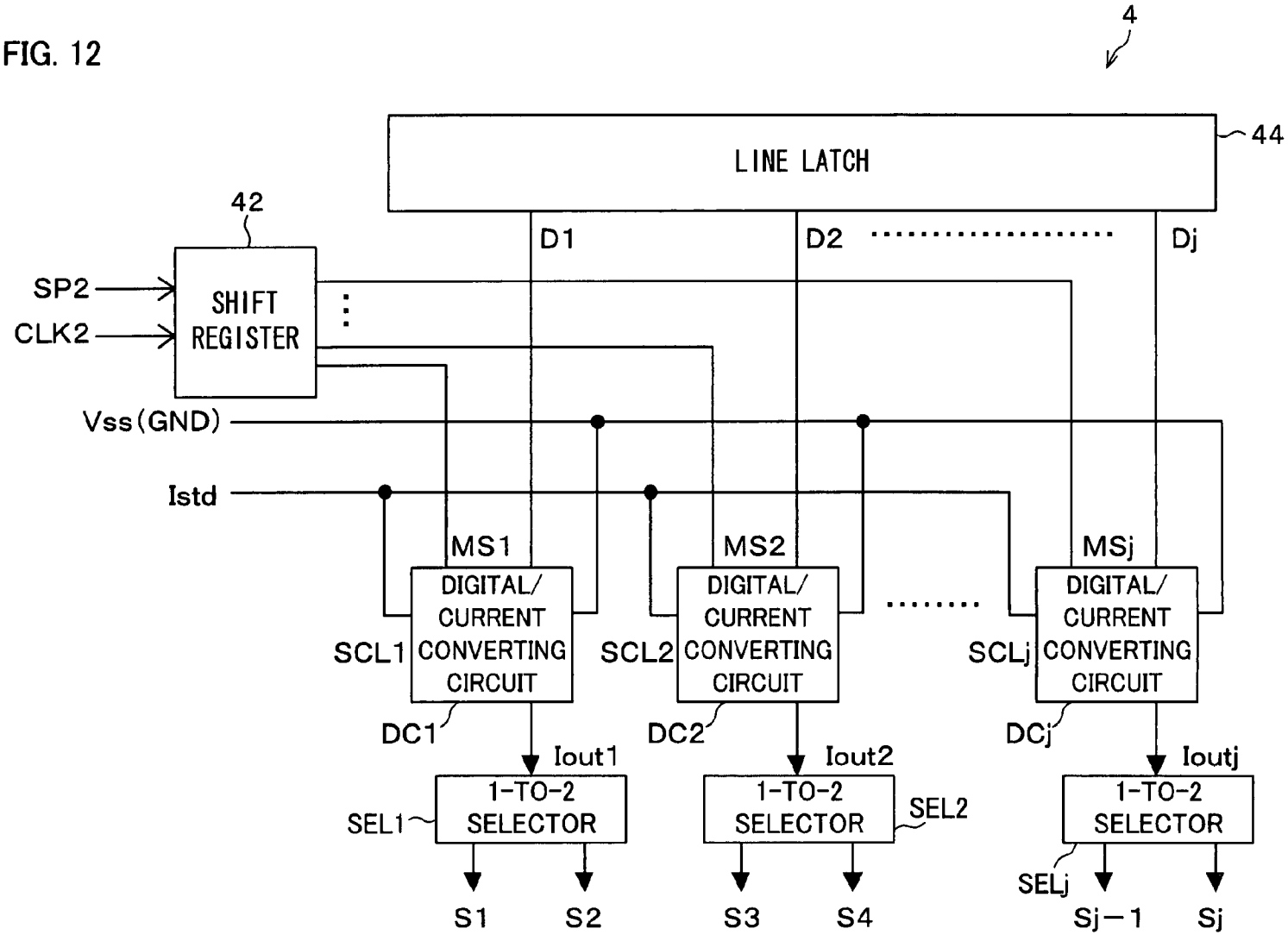
FIG. 12 is a block diagram showing part of another data driving circuit provided in the display device according to the First Preferred Embodiment of the present invention.

It is assumed here that the driving method of the present preferred embodiment is applied to a display device having the circuit structure shown in FIG. 1, and in which the required time T for the refresh of the DCC circuit DC is no longer than half the one horizontal scan period (time H). In this case, as shown in FIG. 12, a single DCC circuit DC may be connected to two data lines S via a 1-to-2 selector circuit SEL (SEL1 through SELj), which is a select-output circuit that selects two outputs from a single output.

Such a configuration corresponds to the conventional operation method in which one horizontal scan period is divided in half by the 1-to-2 selector 106. Irrespective of the driving mode (analog or digital), only a single DCC circuit DC (6-bit DCC-A or 6-bit DCC-B of Publication (1)) is connected to each data line in the driving method of the present preferred embodiment. Thus, by comparing the interconnection pattern of the DCC circuits using the present driving method and the paired interconnection pattern of the conventional example, the data driving circuit 4 requires half the number of DCC circuits DC.

That is, only a single DCC is connected to each data line and outputs the image data signal. Accordingly, the total number of DCC circuits DC is equal to or less than the total number of data lines S.

Thus, where $H \geqq dT$ is satisfied with the one horizontal scan period (time H) divided into d periods as in the conventional examples, the number of DCC circuits DC required for the data driving circuit 4 as a whole can be reduced to n/d (where n is the number of data lines) by dividing the output of the DCC circuit DC by d, provided that the write time W of the pixel circuits Aij is sufficiently long ($W \geqq H/d$). That is, compared with the conventional examples, the number of DCC circuits DC required for the data driving circuit 4 is reduced in half (d DCC circuits DC). This greatly reduces the area occupied by the data driving circuit 4 and thereby reduces the size of the display device.

On the other hand, when the current value needs to be applied to the pixel circuits over the entire duration of one horizontal scan period (i.e., when d=1), the number of DCC circuits DC required for the data driving circuit 4 as a whole is n. However, even in this case, a selector circuit such as the 1-to-2 selector used in the conventional examples is not required. Indeed, the use of a selector circuit is not preferable in the light of the aperture ratio of the pixels, because it requires a greater number of control lines in the pixel circuit. This is particularly prominent and a selector circuit should not be used in a high-definition display device including the bottom-emission configuration.

When the hold period for the DCC circuit DC to hold its current value (time Th) is longer than one frame period (time Tf), i.e., when the current value for the DCC circuit DC is held for two frame periods for example, the shift register 42 as shown in FIG. 1 or FIG. 12 may operate at a different timing. In this case, the DCC circuit DC is refreshed by outputting the current memory signal pulse to the current memory signal line MSj with such a timing that all the DCC circuits DC are refreshed in two frame periods.

Figure 13:
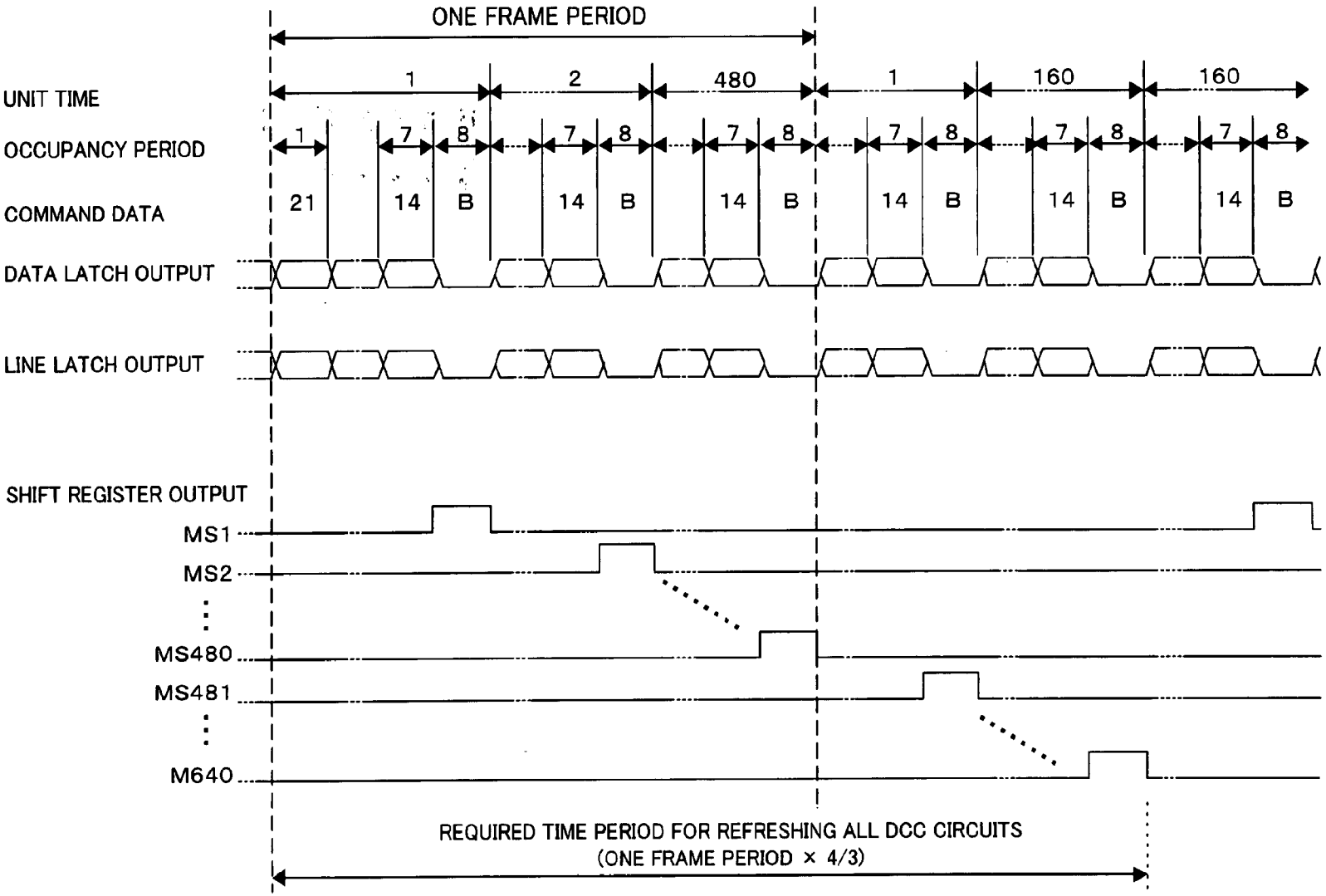
FIG. 13 is a timing chart showing an operation according to another driving method in the display device according to the First Preferred Embodiment of the present invention.

FIG. 13 is a driving timing chart for the VGA class display device using the described driving method. As for the unit time, occupancy period, line latch output, and the like, FIG. 13 is the same as FIG. 10 or FIG. 11.

In FIG. 11, the blanking scan period is divided in half so that all the DCC circuits DC are refreshed within one frame period. On the other hand, in FIG. 13, 640 blanking scan periods are provided as follows. Specifically, a set of occupancy periods 8 in the previous one frame period ending with unit time 480, and a set of occupancy periods 8 ending with unit time 160 in the current one frame period are regarded as one refresh period, and the shift register 42 outputs the current memory control pulse through the current memory signal lines MS1 through MS640 at such timings that all the 640 DCC circuits DC are refreshed within this refresh period. Thus, FIG. 13 differs from FIG. 10 and FIG. 11 in that the refresh of the DCC circuit DC from which the refresh is started (the first DCC circuit DC refreshed; the circuit connected to the current memory signal line MS1 in this example) does not synchronize with the start of one frame period. That is, there is always a DCC circuit DC that is refreshed in a blanking scan period.

By comparing FIG. 11 and FIG. 13, it can be seen that the shift register 42 has a lower operating frequency with the operation timings of FIG. 13, despite that the display devices have substantially the same structure (e.g., the display panel 1 is of VGA in both cases). Thus, with the operation timings of FIG. 13, power consumption can be reduced even in the display devices of substantially the same structure.

As described, when the hold period for the DCC circuit DC to hold its current value is longer than one frame period, the shift register 42 that supplies refresh timings for the DCC circuits DC can operate at a lower operating frequency, thereby reducing power consumption of the circuit. It is preferable that the method of refreshing all the DCC circuits DC over a plurality of frame periods be carried out alone or in combination with the method of refreshing a plurality of DCC circuits DC within a blanking scan period. In this way, a fewer number of DCC circuits DC needs to be refreshed within one frame period, even when the number of data lines S, i.e., the number of DCC circuits DC is considerably larger than the number of scan lines. This enables the driving method to accommodate a display device with a notably large aspect ratio, for example, with the length (data lines S) exceeding the height (scan lines G) by several fold.

Figure 14:
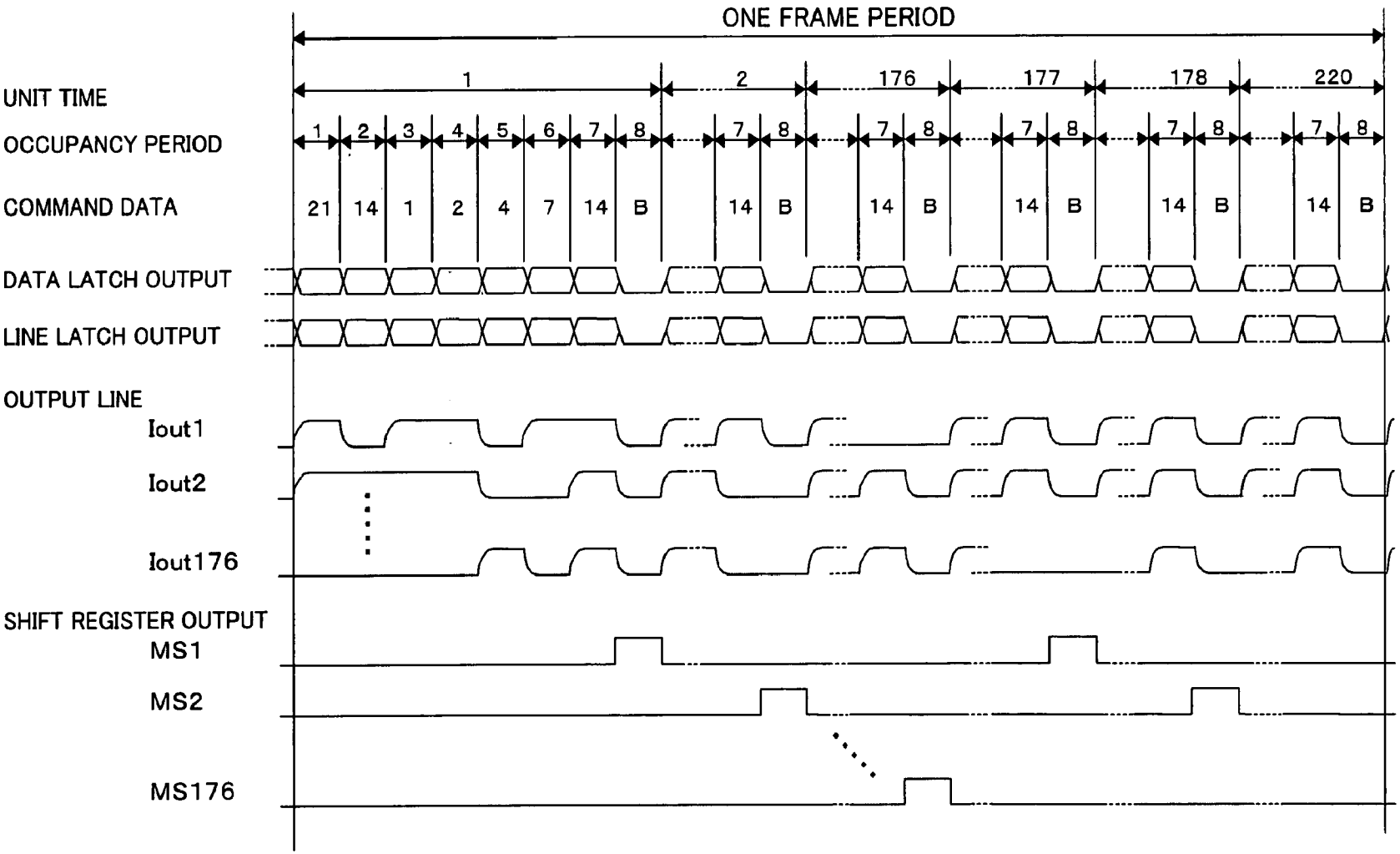
FIG. 14 is a timing chart showing another operation in the display device according to the First Preferred Embodiment of the present invention.

In the driving in which all the DCC circuits DC are refreshed within one frame period wherein the refresh of a first DCC circuit DC does not synchronize with the frame period, the following will describe how a first DCC circuit DC is refreshed following the refresh of a last DCC circuit DC. FIG. 14 is a timing chart according to this driving method. Note that, the timing chart shows the operation timings of the (QCIF class) display device according to the timing chart of FIG. 10. Further, the settings of the display device, such as the number of scan lines also remain the same.

In a certain display state of the display device, FIG. 14 assumes that a refresh signal (shift register output) is supplied to the current memory signal line MS1 in the blanking scan period in unit time 1. The display device is set such that the refresh signal is supplied to the current memory signal line MSj every time a blanking scan period is selected. Thus, in the blanking scan period in the next unit time 2, the refresh signal is supplied to the current memory signal line MS2. The refresh is successively carried out to output the refresh signal up to the current memory signal line MS176 in unit time 176, thereby refreshing all the DCC circuits DC within one frame period.

In the next unit time 177, the refresh signal is supplied again to the current memory signal line MS1, as shown in FIG. 14. That is, FIG. 14 shows the manner in which the refresh operation is repeatedly carried out continuously from a first DCC circuit DC to a last DCC circuit DC, without synchronizing with one frame period. Thus, with the driving method, the hold period for the current value of the DCC circuit DC is only 176/220 of one frame period at most. This reduces the capacitance of the capacitor provided in the DCC circuit DC (storing means), thus reducing the circuit area.

Second Preferred Embodiment

In the present preferred embodiment, the electro-optic element changes its display state M times in one frame period (where M is an integer of not less than 1), and the display state is set to be any one of R display states (where R is an integer of not less than 2) as determined by the current output of the DCC circuit DC. Based on this driving method, the following will describe an example of a structure of a display device that carries out N gradation display ($N \leqq R^M$) with M=1, i.e., a display device using a common analog driving mode with the foregoing driving method.

The display device of the present preferred embodiment preferably has essentially the same structure as the display device of the First Preferred Embodiment as shown in FIG. 2. However, instead of the data driving circuit 4 (see FIG. 1), a data driving circuit 8 is provided. More specifically, the display device of the present preferred embodiment differs from the display device of the First Preferred Embodiment in that the data driving circuit 8 can output, for example, R different current values, so that the electro-optic element can display R states according to the number of outputs of the reference current source 6.

In the analog driving mode of the present preferred embodiment, one horizontal scan period, during which a scan line Gi is selected, is divided into a first half and a second half. The first period provides a blanking scan period, i.e., a refresh period for the DCC circuit DC, with the data line S and the output switching element of the data driving circuit 8 (see FIG. 15) turned off. The second half provides an output period (display period) for outputting the image data signal to the pixel circuit Aij. Generally, the analog driving method carries out a scan only once in one frame period when the image data signal is sent. In contrast, in the present preferred embodiment, the scan period of the image data signal is divided in half, and the blanking signal and the image data signal are continuously sent. This is equivalent to continuously carrying out the scan two times.

Figure 15:
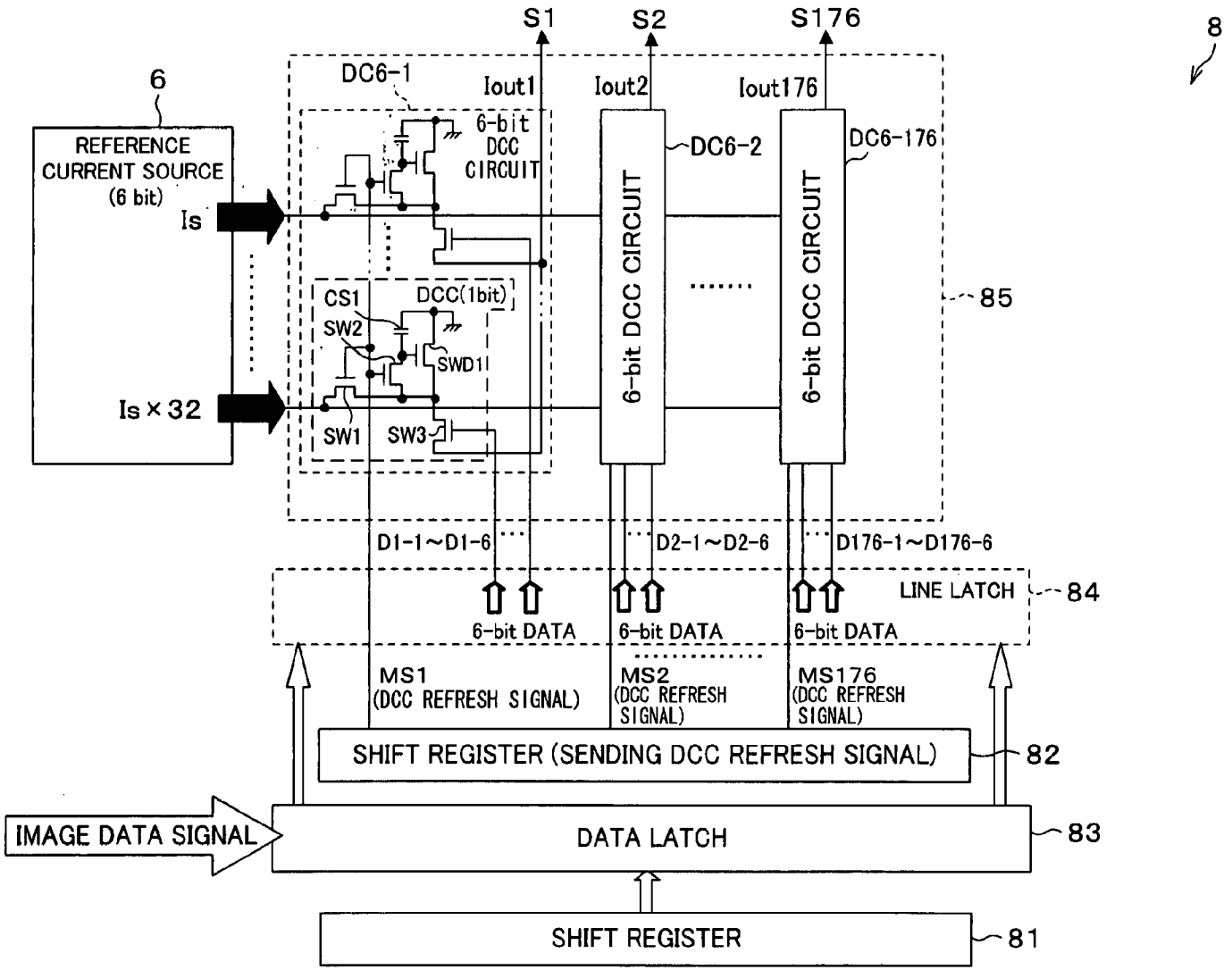
FIG. 15 is a block diagram showing a structure of a data driving circuit provided in a display device according to a Second Preferred Embodiment of the present invention.

FIG. 15 shows a display device using the driving method of a preferred embodiment of the present invention, in which a current-controlled analog driving mode for 6-bit gradation display for each color of RGB is used.

The display device shown in FIG. 15 is of the QCIF class with a display panel 1 having 176 data lines×3 (RGB)×220 scan lines. The shift register circuit 8 is provided in the structure of the display device shown in FIG. 2. The data driving circuit 8 includes shift registers 81 and 82, a data latch 83, a line latch 84, and a voltage/current converting circuit 85.

The shift register outputs a timing signal as does the shift register 41. The data latch 83 latches an input 6-bit image data signal for each data line at a timing of the timing signal produced by the shift register 81. The image data signal of each data line latched in the data latch 83 is transferred in parallel to the voltage/current converting circuit 85 by the line latch 84.

As with the shift register 42, the shift register 82 receives a start pulse signal from the control circuit 2, and transfers it in synchronism with a clock signal supplied by the control circuit 2. As a result, the shift register 82 outputs a current memory control pulse (DCC refresh signal) at the corresponding timing in synchronism with a blanking scan period. The current memory control pulse is outputted from the respective output stages of the shift register 82 through current memory signal lines MS1 through MS176. Further, the shift register 42 serves as a control circuit since it outputs the current memory control pulse at a refresh timing of the DCC circuit driven by the driving method shown in FIG. 16 or FIG. 18 (described later).

The voltage/current converting circuit 85 includes 176 6-bit DCC circuits (digital/current converting circuits) DC6-1 through DC6-176 (signal output circuits). Each 6-bit DCC circuit DC**6-*j*** includes six 1-bit DCC circuits, with which the image data signals are converted into current signals and are outputted to the pixel circuit Aij through the data line S. Here, the converted current signals are outputted as analog image data signal data through a single output line Ioutj.

Note that, the data driving circuit 8 shown in FIG. 8 has a driving circuit structure only for the color component R among three primary colors of RGB, for example. In the structure shown in FIG. 15, one horizontal period is divided into a blanking scan period and a period of pre-charge and image data signal transmission.

Figure 20:
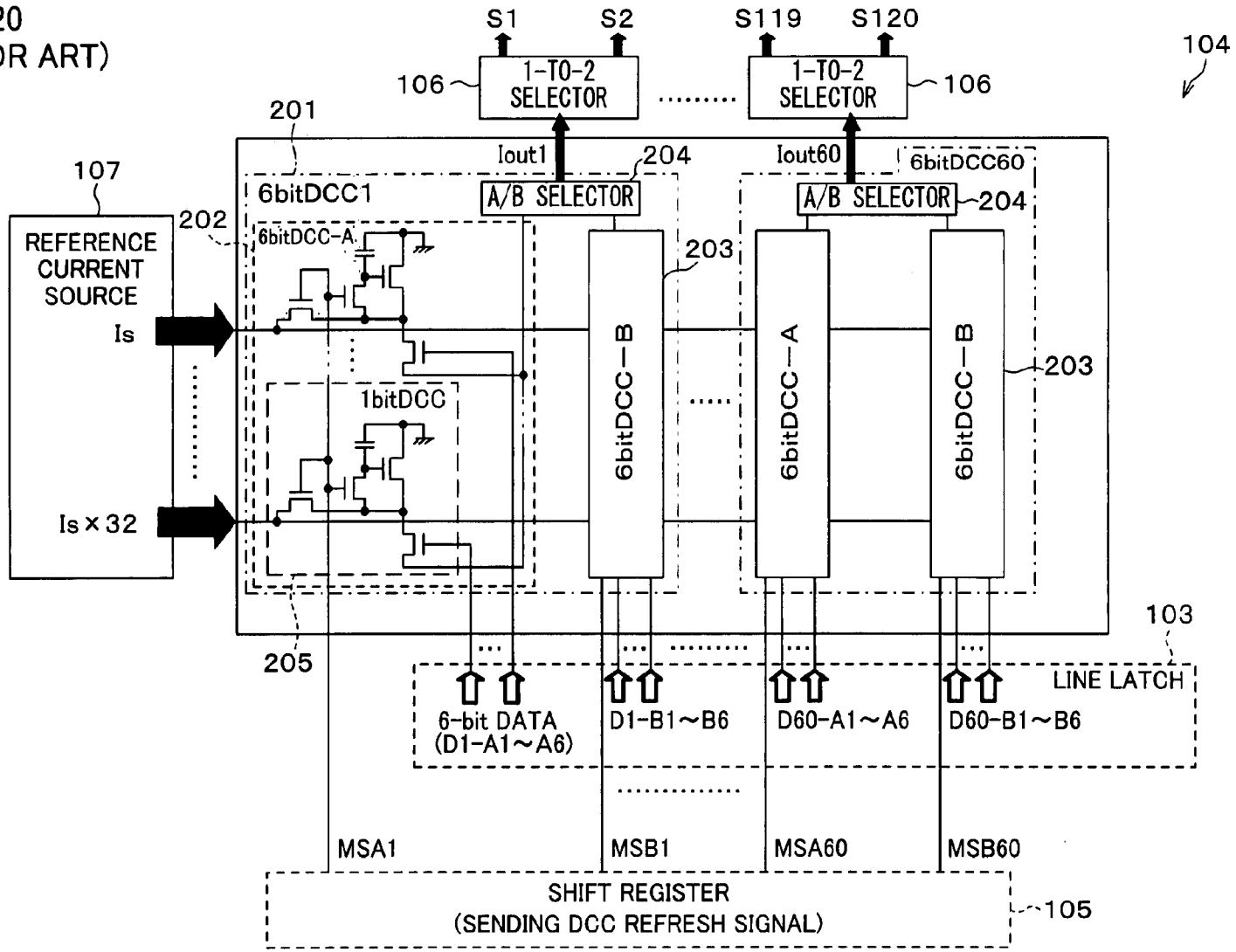
FIG. 20 (PRIOR ART)
FIG. 20 is a block diagram showing a structure of a data driving circuit provided in the display device of FIG. 19.
Figure 21:
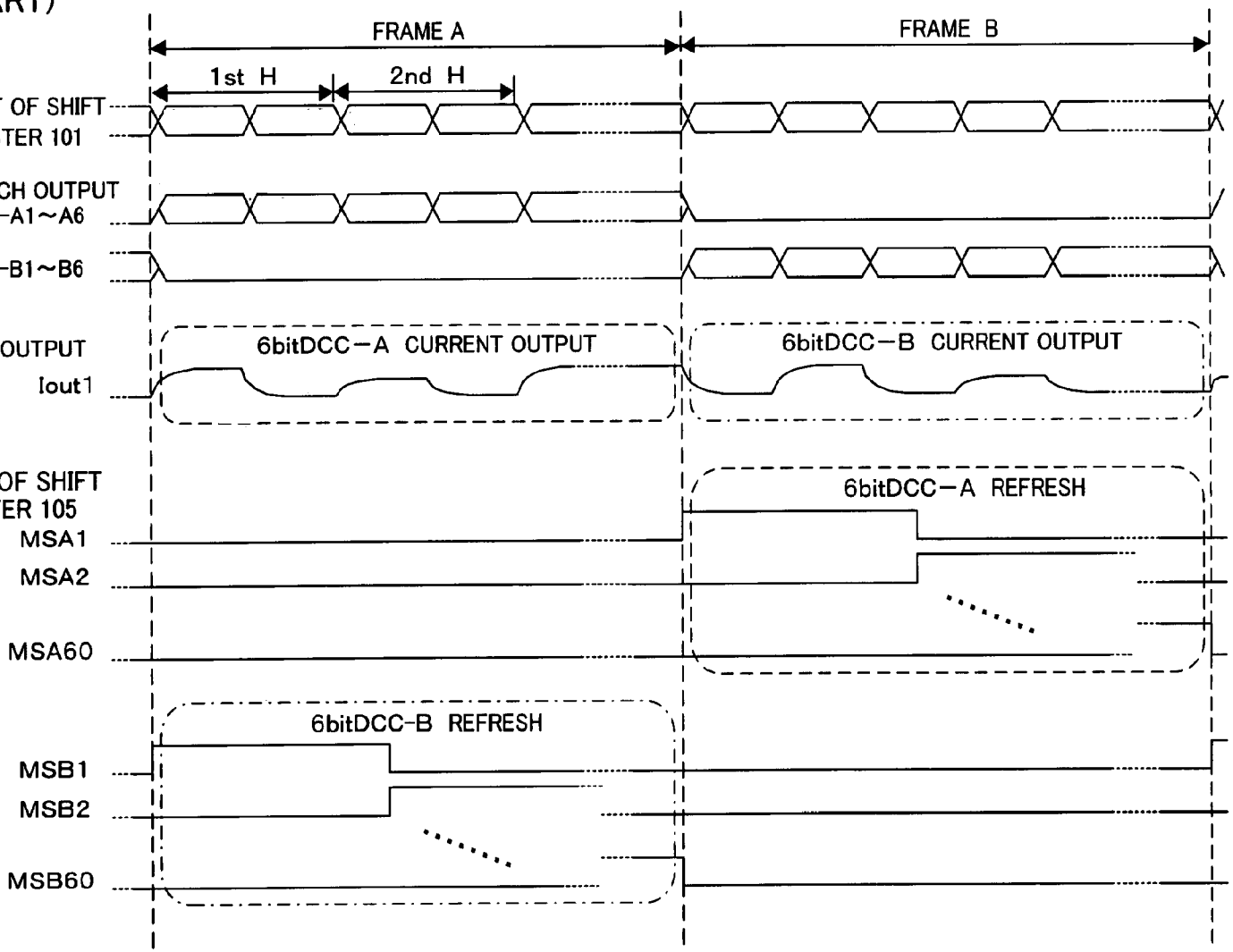
FIG. 21 (PRIOR ART)
FIG. 21 is a timing chart showing an operation of the data driving circuit shown in FIG. 20.

The display device shown in FIG. 15 uses the driving method in which the input image data signal is stored in the data latch 83 and the line latch 84 in this order, and then transferred to the 6-bit DCC circuit DC6-*j*. This is essentially the same as that disclosed in Publication (1) described with reference to FIG. 19 and FIG. 20.

The voltage/current converting circuit 85, however, uses the driving method of various preferred embodiments of the present invention in which the DCC circuits DC are refreshed using a blanking scan period. Thus, unlike the conventional display device, the voltage/current converting circuit 85 can apply the image data signal to the pixel circuits Aij without alternately switching the states of the DCC circuits DC making up a pair. Therefore, the voltage/current converting circuit 85 does not require the A/B selector 106 (see FIG. 20) between the data line S and the 6-bit DCC circuit DC6-*j*.

Further, only one 6-bit DCC circuit DC6-*j* is connected to each data line Sj, cutting the number of DCC circuits DC in half from the display device of the conventional example. Thus, the conventional structure can be realized with the same number of DCC circuits DC in the voltage/current converting circuit 85, even when the 1-to-2 selector 106 is not used.

To be more specific, the circuit scale is increased when a blanking scan is to be carried out within one frame period at a different timing from the scan that is carried out to send the image data signal. This is because two different scan timings need to be sent to the gate driving circuit 5 by being generated in the control circuit 2 externally provided outside of the display device, or two scan signals need to be generated in the display device or from the scan signal supplied to the gate driving circuit 5.

In light of this drawback, the scan, which is carried out once in one frame period, is carried out such that a blanking scan and the signal transmission to the pixel circuits Aij are successively performed in the divided periods of one horizontal scan period, wherein the horizontal scan period is divided by switching the ON/OFF of a circuit that controls the signal output to the pixel circuits Aij in the data driving circuit 8. In this way, the data driving circuit 8 involved in the scan can be realized in a size required to carry out a single scan in one frame period.

However, a switching element or switching circuit for dividing one horizontal scan period needs to be provided between the data driving circuit 8 and each data line S.

The structure including the switching circuits is not specific to the present invention, and it is equally effective in a common analog driving mode, as described below.

As described in the First Preferred Embodiment, the display device using the current-controlled analog driving mode including the organic EL element as the electro-optic element in particular requires a very small current value for its driving circuit when setting a luminance for a low gradation value. Accordingly, it takes some time to store the current value in the driving circuit. The same is the case for the pixel circuits Aij.

Thus, in the display device of the current-controlled analog driving mode, it is preferable that pre-charge be carried out before the current of the image data signal is applied to the pixel circuit Aij, so as to reduce the time required to store the current.

The pre-charge is generally carried out immediately before the signal is applied to the pixel circuit Aij, and a voltage may be applied separately from the operation of the DCC circuit DC and at a different timing from the transmission of the image data signal. Thus, in the described method in which one horizontal scan period is divided into a blanking scan period and a scan period for the transmission of the image data signal, the pre-charge can be carried out within the blanking scan period.

However, it is more preferable that the pre-charge circuit determine the pre-charge voltage for the pixel circuit Aij by referring to the next current value the DCC circuit DC applies to the pixel circuit Aij. In this way, the pre-charge can be carried out without excess or deficiency. In this case, an output state of the DCC circuit DC needs to be maintained during the pre-charge. It is therefore preferable that one horizontal scan period be divided into a blanking period, a pre-charge period, and a signal transmission period for the image data signal, or into a blanking scan period and a signal transmission period for the image data signal. It is also preferable that the signal transmission period for the image data signal be further divided to provide a pre-charge period and a signal transmission period for the image data signal, as in Publication (2).

With the movement toward high-definition display devices, the area of the electro-optic element has been reduced and the light emitting efficiency of the electro-optic element (particularly organic EL element) has been increasing. As a result, the supplied current value to the pixel circuits Aij is expected to decrease in the future. It is therefore preferable that the display device using the organic EL element for the electro-optic element be provided with a pre-charge circuit.

By providing the pre-charge circuit, and with the signal transmission period of the image data signal divided to provide a blanking scan period, a pre-charge period, and a scan period for the image data signal, the circuit scale can be reduced without major modification to the conventional driving circuit.

In order to switch the outputs of the pre-charge circuit and the DCC circuit DC, a switching circuit needs to be provided between the data driving circuit 8 and each data line S. It is therefore preferable in implementing the preferred embodiments of the present invention that the pre-charge circuit and the DCC circuit DC be used to divide one horizontal scan period, because no additional structure will be required in this case.

Note that, no detailed explanation will be given for the pre-charge circuit because it is described in detail in Publication (2) or Tokukai 2003-195812.

Figure 16:
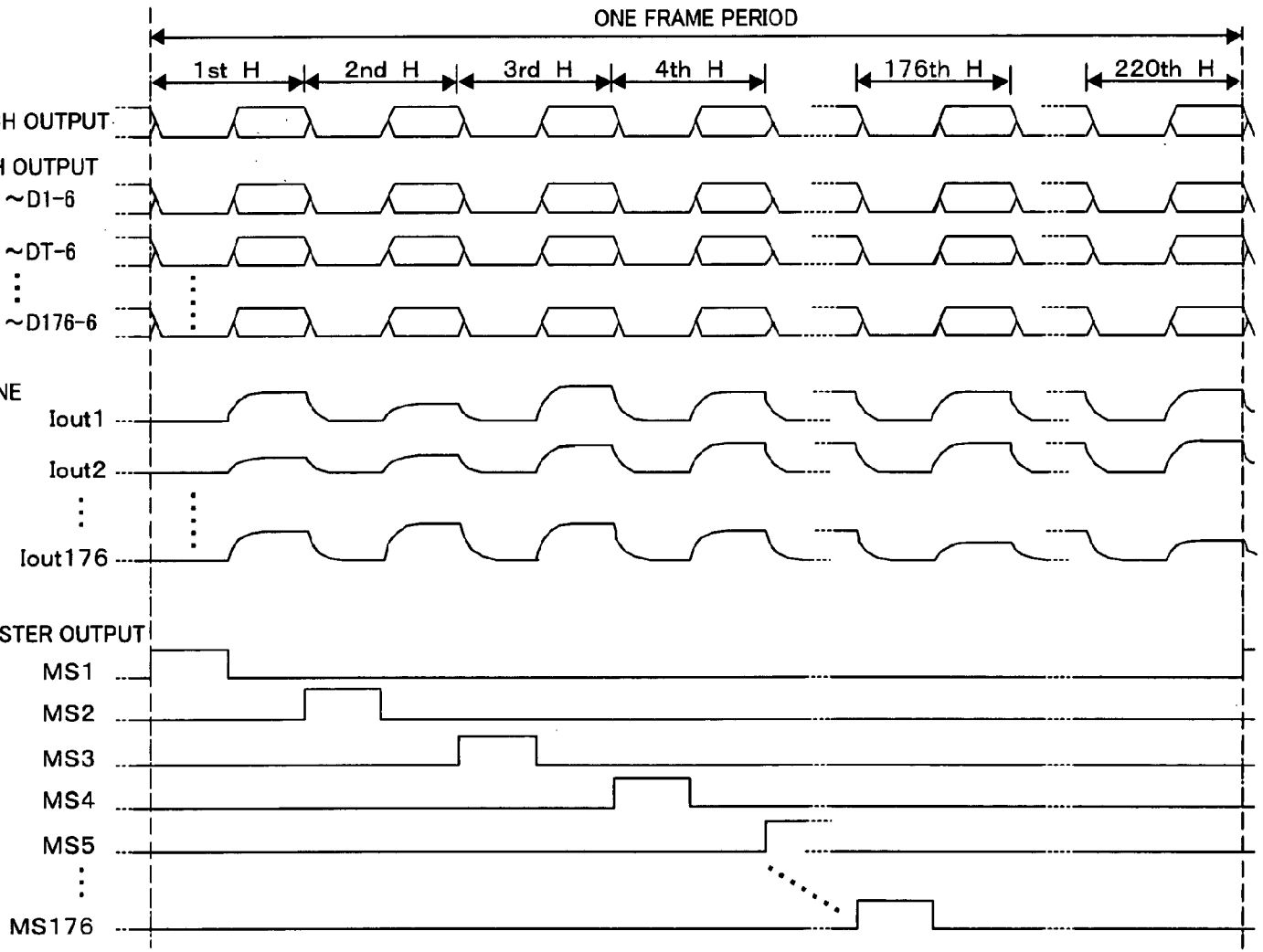
FIG. 16 is a timing chart showing an operation of the display device including the data driving circuit shown in FIG. 15.

FIG. 16 is a driving timing chart for the display device of FIG. 15. In FIG. 16, the horizontal axis represents time, and the vertical axis represents data latch output, line latch output (digital signals DT1-1 through DT1-6, . . . , DT176-1 through DT176-6), output through output lines (Iout 1 through Iout176), and output (current memory control pulse outputted through the current memory signal lines MS1 through MS176) from the shift register 82.

First, in a select period 1stH, a scan line Gi is selected. In the first half of the select period 1stH, all the line latch outputs (digital data output lines Dj-1 through Dj-6) are low (L) potential. This turns off the switching element 3 of the DCC circuit DC, and a current memory signal pulse of ON (H) level is applied to the current memory signal line MS1. As a result, the DCC circuit DC1 is refreshed.

In the second half of the select period 1stH, the pre-charge and the transmission of the image data signal are carried out successively. In this period, an OFF (L) level signal is supplied to the current memory signal line MS1, and the line latch outputs signals of the respective bits according to the image data signals. As a result, the DCC circuits DC are turned on (output state), causing the pre-charge and the transmission of the image data signal to be carried out successively for the pixel circuits Aij on the scan line Gi.

In the next select period 2ndH, a scan line Gi+1 is selected. In the first half of the select period 2ndH, as in the select period 1stH, all the line latch outputs are low (L) level, and the current memory control pulse is supplied to the current memory signal line MS2. As a result, the DCC circuit DC is refreshed. In the second half of the select period 2ndH, the pixel circuits Aij on the scan line Gn+1 is pre-charged and the image data signal is applied thereto.

Thus, with the driving method of the present preferred embodiment, the conventional structure can be realized without increasing the number of DCC circuits DC and without using a pair of selectors conventionally required between the DCC circuit DC and the data line.

In effect, this is the same as requiring only one DCC circuit DC for each data line. Further, the conventionally required selector circuits between the data lines and the DCC circuits DC are not required at all, thus reducing the circuit area and power consumption for the selector circuits. Further, because it is not required to divide one horizontal scan period using the 1-to-2 selector as in the conventional example, more time can be afforded to apply the signal to the pixel circuits Aij. This is particularly advantageous in applying a low-luminance image data signal, i.e., small current.

Basically, the driving method of the present preferred embodiment is not dependent on the circuit structure other than the structure of the driving circuit for driving the pixel circuits Aij or other circuits. Thus, the data driving circuit 8 shown in FIG. 15 may adopt a structure in which, as shown in FIG. 17, the DCC circuit DC is shared by adjacent data lines Sj and Sj+1, using the 1-to-2 selectors SEL1 through SEL88, as in the conventional example.

In this structure, the 1-to-2 selector circuits SEL1 through SEL88 are additionally provided as a select-output circuit in the structure of FIG. 15, and the data driving circuit 8 operates at a higher operating frequency because of the divided one horizontal scan period. However, the number of necessary DCC circuits DC is further cut in half from the structure of the display device shown in FIG. 15. Thus, the display device shown in FIG. 15 has only half the conventionally required number of DCC circuits DC. Specifically, the display device of FIG. 15 includes 88 DCC circuits DC for 176 data lines S. Note that, in order to use the driving method this way, the line latch 84 needs to output image data signals such that the image data for the input 176 data lines S are outputted in turn in two groups in synchronism with the switching of the 1-to-2 selector 86.

Figure 17:
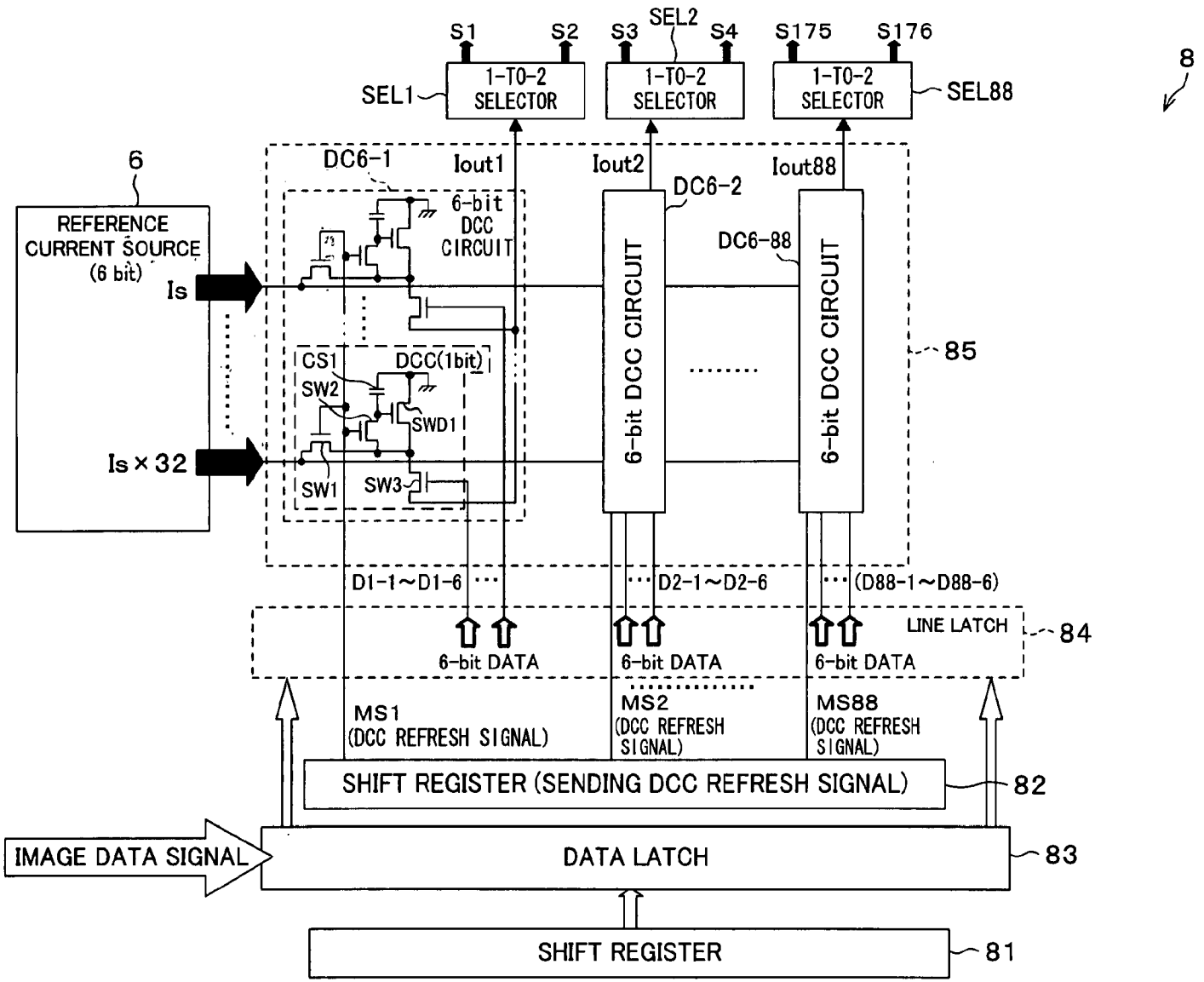
FIG. 17 is a diagram showing a structure of the data driving circuit provided in another display device according to the Second Preferred Embodiment of the present invention.
Figure 18:
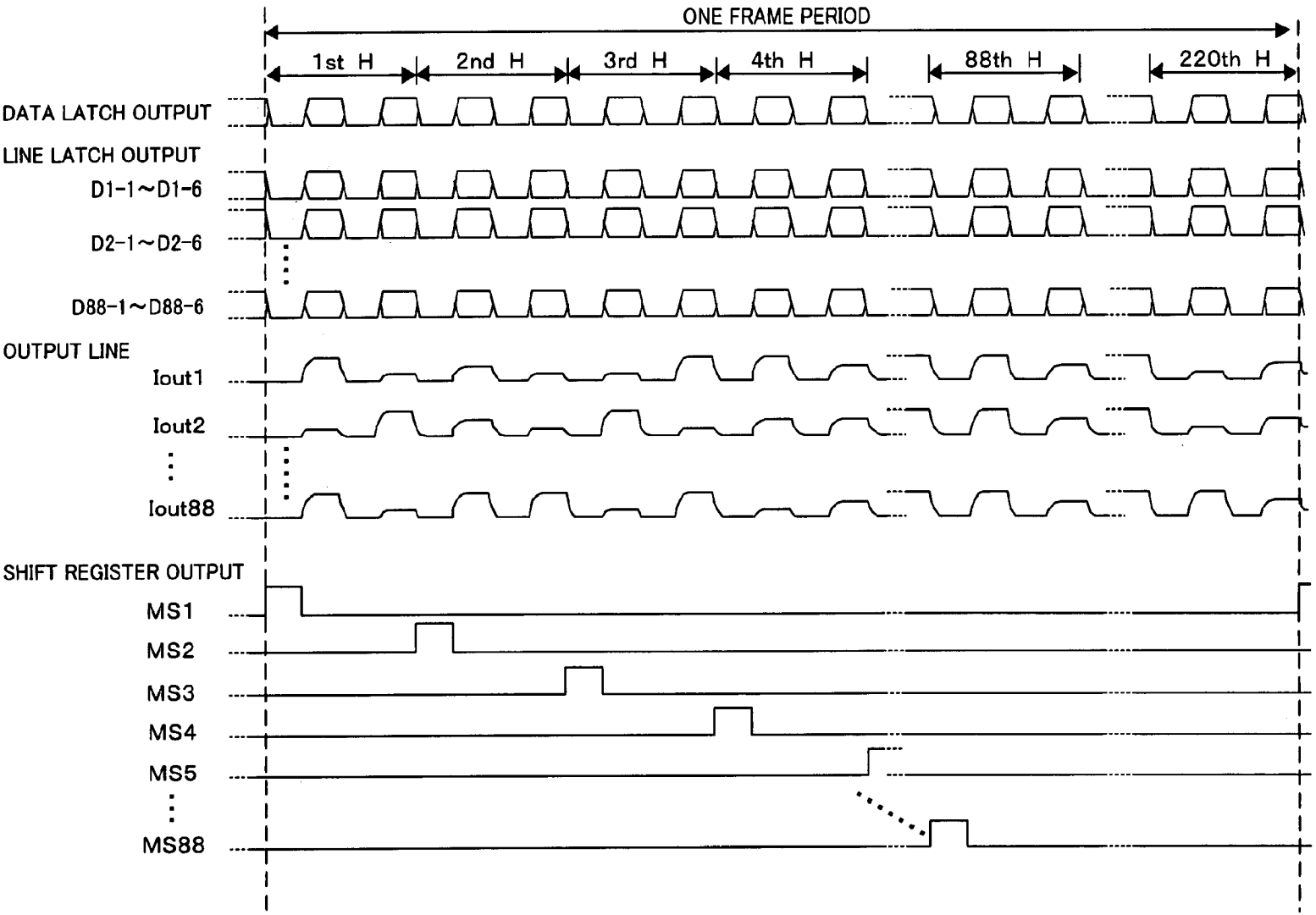
FIG. 18 is a timing chart showing an operation of the display device including the data driving circuit shown in FIG. 17.

FIG. 18 represents a driving timing chart for the display device shown in FIG. 17.

As with the display device of FIG. 15, the display device shown in FIG. 17 uses the driving method in which a blanking scan and the transmission of the image data signal are carried out by dividing one horizontal scan period in half. However, in the display device of FIG. 17, the signal transmission period for the image data signal is further divided into two, so that one horizontal scan period is actually divided into four periods. In the timing chart of FIG. 18 showing the operation of the display device illustrated in FIG. 17, one horizontal scan period is divided into four periods, in which four states of blanking scan, image data signal transmission, blanking scan, and image data signal transmission are repeatedly carried out. In the transmission of the image data signal, the 1-to-2 selector circuits SEL1 through SEL88 connect the DCC circuits DC to one of the data lines S in one instance. In another instance, the DCC circuits DC are connected to the other data line S, wherein the switching is made in a blanking scan period.

On the other hand, the current memory control pulse, which is the refresh signal for the DCC circuit DC, is successively sent from the shift register 82 to the current memory signal lines MSj in synchronism with the blanking scan. In the operating timing shown in FIG. 18, one horizontal scan period has two blanking scans. However, since the number of scan lines exceeds the number of DCC circuits DC, it is not necessarily required to carry out the refresh in every blanking scan. In the operation shown in FIG. 18, the refresh is carried out once in every two blanking scans to complete the refresh of 88 DCC circuits DC. This is because, when the DCC circuit DC holds the output value longer than one frame period, the shift register 82 should preferably operate at the lowest possible operating frequency to reduce power consumption in the circuit. It is therefore preferable that the shift register 82 output the current memory control pulse to the current memory signal line MSj once in every two blanking scans.

As described above, the driving method of the present preferred embodiment is applicable to the display device in which the refresh of the DCC circuits DC requires at most half the one horizontal scan period, even when the display device uses an analog driving mode. Thus, as in the structure described in the First Preferred Embodiment with reference to FIG. 12, the number of necessary DCC circuits DCC can be reduced by sharing the DCC circuits DC with adjacent data lines, using the 1-to-2 selector circuits SEL1 through SEL88. This is preferable in reducing the size of the display device because it greatly reduces the area occupied by the data driving circuit 8.

Third Preferred Embodiment

The present preferred embodiment describes an example of a structure of a display device using the driving method of a common digital driving mode, as in the First Preferred Embodiment.

Figure 23:
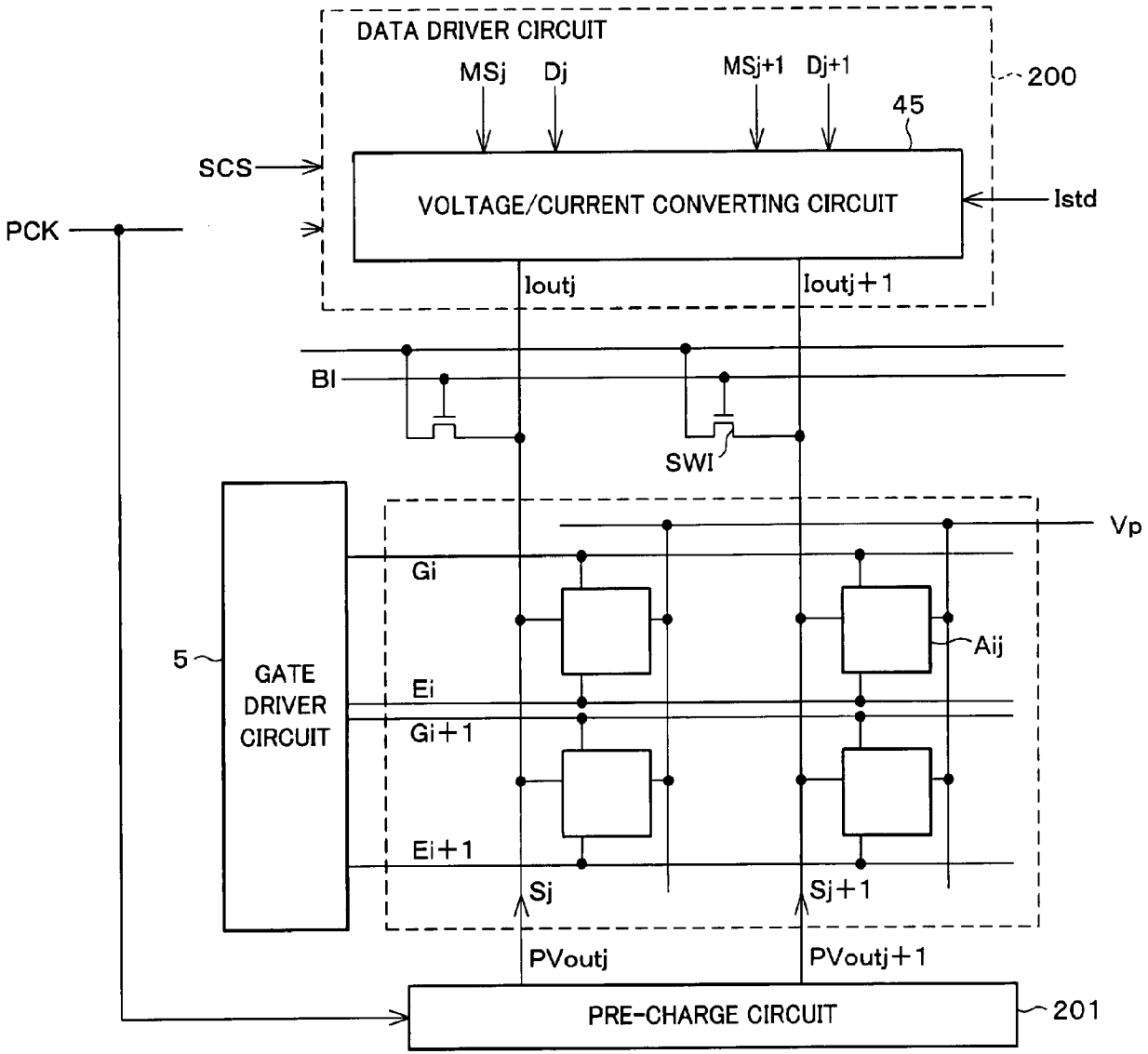
FIG. 23 is a block diagram showing a structure in which a pre-charge circuit is provided in a display device according to a Third Preferred Embodiment of the present invention.

FIG. 23 shows a structure of the display device of the present preferred embodiment. The display device of the present preferred embodiment essentially has the same circuit structure as that of the First Preferred Embodiment, including the pixel circuits and DCC circuits. However, the display device of the present preferred embodiment differs therefrom in that it includes, as shown in FIG. 23, a data driving circuit 200 as a control circuit, and a pre-charge circuit 201 as a potential applying circuit. The pre-charge circuit 201 is not provided in the structure shown in FIG. 9. The outputs of the pre-charge circuit 201 are respectively connected to the data lines Sj, and the pre-charge control signal PCK that controls the timing of pre-charge supplies pre-charge potentials PVoutj through PVoutj+1 to the pixel circuits Aij when the output of the voltage/current converting circuit 45 is an OFF signal. The pre-charge potentials PVoutj through PVoutj+1 are not supplied when the output of the voltage/current converting circuit 45 is an ON signal. That is, the pre-charge circuit 201 operates exclusively. Thus, in the display device of the present preferred embodiment, the voltage/current converting circuit 45 outputs the OFF signal to the pixel circuits Aij in a pre-charge period. The data driving circuit 200 also receives the pre-charge control signal PCK as does the pre-charge circuit 201, and outputs the OFF signal while the pre-charge control signal is applied.

Figure 24:
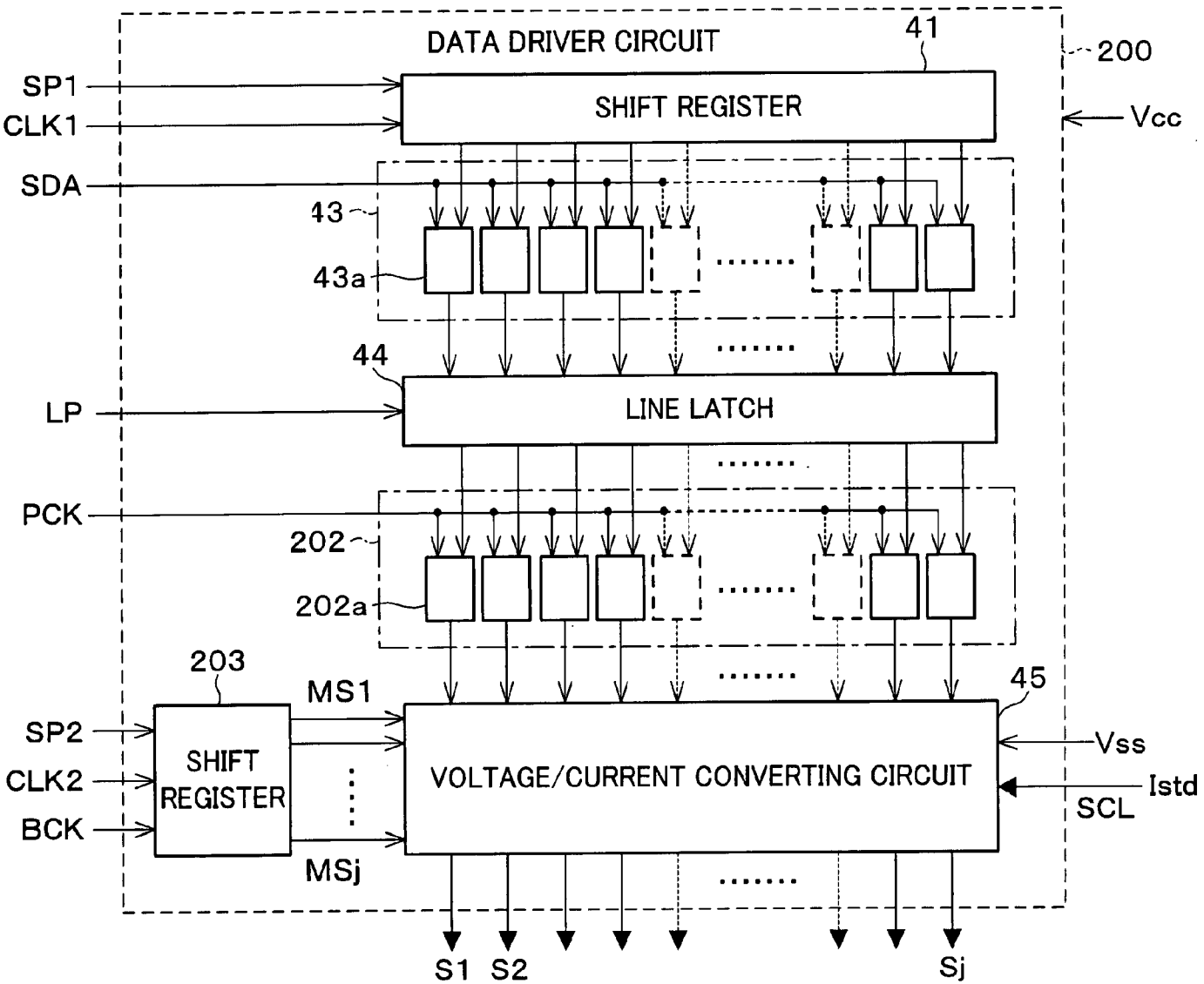
FIG. 24 is a block diagram showing a structure of a data driving circuit provided in the display device according to the Third Preferred Embodiment of the present invention.

FIG. 24 shows a structure of the data driving circuit 200. The data driving circuit 200 essentially has the same circuit structure as the data driving circuit 4, including the shift register 41, the data latch 34, the line latch 44, and the voltage/current converting circuit 45. However, the data driving circuit 200 differs from the data driving circuit 4 in that the shift register 42 of the data driving circuit 4 has been replaced with a shift register 203, and that the output of the line latch is supplied to the voltage/current converting circuit 45 via the timing circuit 202. The timing circuit 202 includes a plurality of flip-flops 202*a*. In the timing circuit 202, the image data signal SDA of one line supplied from the line latch 44 is outputted according to the pre-charge control signal PCK either directly or after it is converted into a signal that causes the voltage/current converting circuit 45 to always output the OFF signal.

In the data driving circuit 200, the shift register 41, the data latch 43, the line latch 44, and the voltage/current converting circuit 45 operate in the same manner as in the data driving circuit 4 described above.

However, the output of the line latch 44 is directly transferred to the voltage/current converting circuit 45 in a high (H) level period of the pre-charge control circuit PCK, for example. In a low (L) level period of the pre-charge control circuit PCK, the output of the line latch 44 is converted by the timing circuit 202 into a signal that causes the voltage/current converting circuit 45 to always output the OFF signal. Thus, the voltage/current converting circuit 45 sends the ON signal to the pixel circuit Aij when it receives the high (H) level signal for example, and sends the OFF signal to the pixel circuit Aij when it receives the low (L) level signal. As a result, the output of the line latch 44 is directly outputted when the pre-charge control signal PCK is at high (H) level, and a low (L) level signal is always sent to the voltage/current converting circuit 4 when the pre-charge control signal PCK is at low (L) level.

With the described structure, the voltage/current converting circuit 45 always outputs the OFF signal in the low (L) level period of the pre-charge control signal PCK. That is, in the pre-charge period, the voltage/current converting circuit 45 can reset all current values.

It is preferable in the foregoing structure that the pre-charge circuit 201 supply a pre-charge potential to the pixel circuit Aij when the pre-charge control signal PCK is at low (L) level, and that the pixel circuit Aij be disconnected from the pre-charge circuit 201 when the pre-charge control signal PCK is at high (H) level. In other words, it is preferable that the digital/current converting circuits SCL of the voltage/current converting circuit 45 stop their output operations for the current signals (ON signals) when the pre-charge control signal is at low (L) level, and that the digital/current converting circuits SCL output the current signals when the pre-charge control signal PCK is at high (H) level. In this manner, the pre-charge circuit 201 and the digital/current converting circuit SCL (signal output circuit) operate exclusively.

As with the shift register 42, the shift register 203 transfers the input start pulse SP2 in synchronism with the clock CLK2, and adjusts the pulse width with the blanking timing signal BCK, so as to output a current memory control pulse to the current memory signal lines MSj through its output stages. The current memory control pulse is outputted in synchronism with the blanking scan period at corresponding timings. In the First and Second Preferred Embodiments, the current memory control pulse is equal to or shorter than one horizontal scan period (1H). The current memory control pulse outputted from the shift register 203 differs from its counterpart in the First and Second Preferred Embodiments in that it corresponds to a length, from the start of the horizontal scan period in which a blanking scan is made, to the end of pre-charge in the next horizontal scan period. This is realized by adjusting the blanking timing signal BCK.

With the foregoing circuit structure, the driving method in which the DCC circuits are successively refreshed in a blanking scan period as described in the First Preferred Embodiment may be used in the driving circuit of the display device of the present preferred embodiment in which a pre-charge period is provided. In this case, the DCC circuits can also be refreshed in a pre-charge period of a scan period immediately following the blanking scan period. That is, the refresh period of the DCC circuit as described in the First Preferred Embodiment can be extended to the end of the pre-charge that is carried out in a scan period immediately following the scan period in which a blanking scan is carried out.

Figure 25:
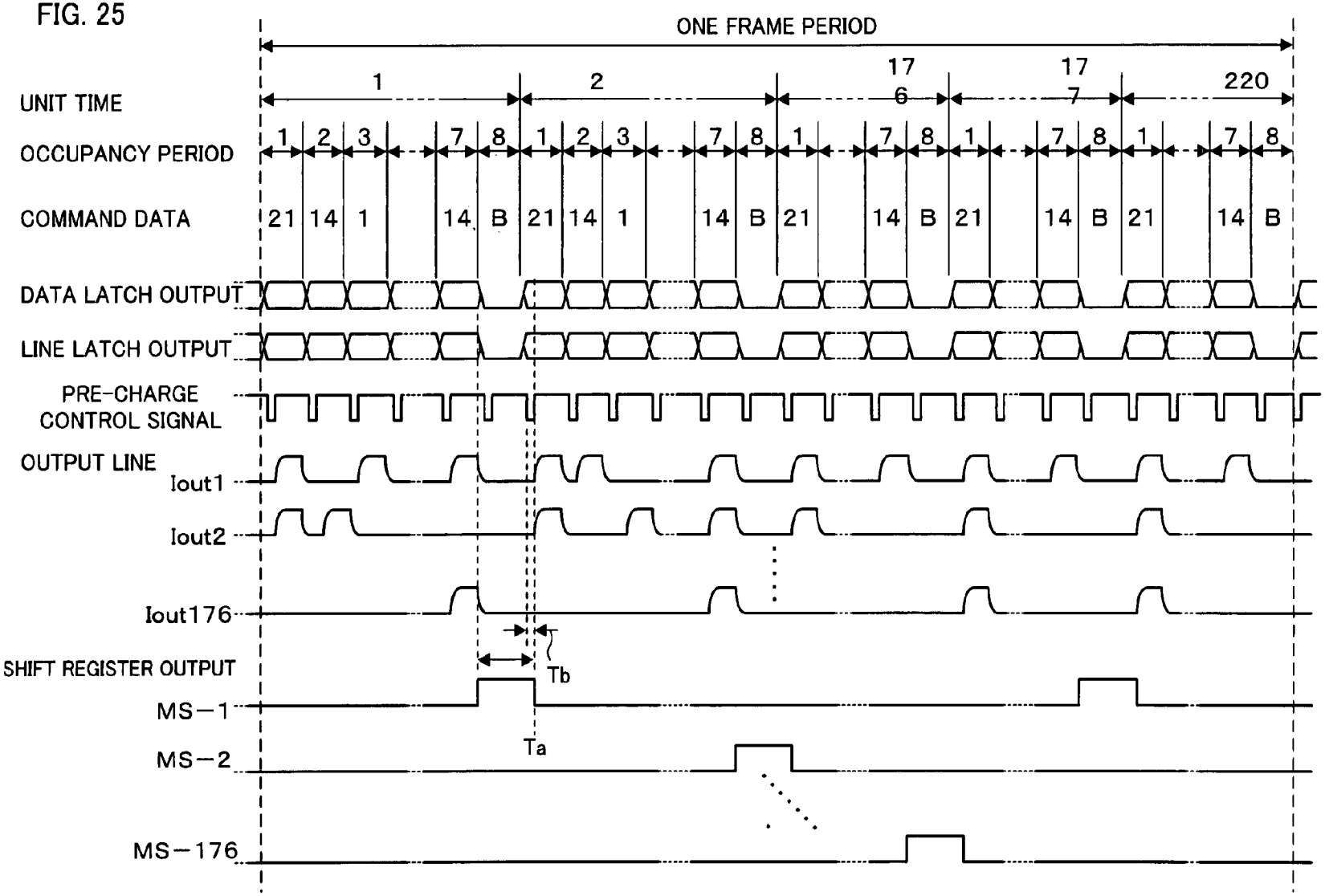
FIG. 25 is a timing chart showing an operation of the display device according to the Third Preferred Embodiment of the present invention.

FIG. 25 is a driving timing chart for the display device using the foregoing driving method when the display device has a display quality of QCIF class, for example.

With the foregoing circuit structure, the driving method in which the DCC circuits are successively refreshed in a blanking scan period as described in the First Preferred Embodiment may be used in the driving circuit of the display device of the present preferred embodiment in which a pre-charge period is provided. In this case, the DCC circuits can also be refreshed in a pre-charge period of a scan period immediately following the blanking scan period. That is, the refresh period of the DCC circuit as described in the First Preferred Embodiment can be extended for the duration of the pre-charge period.

FIG. 25 is a driving timing chart for the display device using the foregoing driving method when the display device has a display quality of QCIF class, for example.

The pixel circuit Aij and the driving method remain basically the same as those described in the First Preferred Embodiment. In FIG. 25, as in the timing chart shown in FIG. 10, the occupancy period 8 corresponds to the blanking scan period, and the refresh signals for the DCC circuits are successively sent through the shift register outputs MS-1, MS-2, . . . , MS-176 in a time sequence of unit times 1, 2, . . . , 176. However, the shift register output MSj does not become low (L) level at the end of the occupancy period 8, and it remains high (H) level until the end of the pre-charge period in the next occupancy period 1. This means that the voltage/current converting circuit 45 outputs only the OFF signal in the low (L) level period of the pre-charge control signal PCK (corresponds to the pre-charge period Tb in FIG. 25) as described above, and that the successive refresh of the corresponding DCC circuit DCj is carried out not only in the occupancy period 8, which is a blanking scan period, but also in a period from the start of the occupancy period 1 immediately following the occupancy period 8, to the end of the pre-charge period Tb (corresponds to Ta in FIG. 25). Thus, compared with the structure of the First Preferred Embodiment shown in FIG. 10, the refresh period of the DCC circuit can be extended for the duration of the pre-charge period Tb in each scan period.

By thus extending the refresh period of the DCC circuit using the driving circuit of the described structure and the foregoing driving timing, the current value of the DCC circuit can be stored more accurately. Further, it allows for use of smaller current values, expanding the available range of current value.

SUMMARY OF THE PREFERRED EMBODIMENTS

As described above, the driving circuit of the respective preferred embodiments is for driving a pixel circuit in a display device that includes a plurality of scan lines, at least one data line, and the pixel circuit, wherein the pixel circuit includes an electro-optic element and is disposed in a matrix at each intersection of the scan lines and the data line, and the driving circuit includes: a signal output circuit (DCC circuit) which holds a current value of a reference ON signal that turns on the electro-optic element, the signal output circuit outputting the ON signal to the data line with a current value held according to ON data, and outputting an OFF signal to the data line so as to turn off the electro-optic element according to OFF data; and a control circuit (shift register) which controls the hold operation of the signal output circuit so as to enable the ON signal to reset its current value within a set period in which a display state of all pixel circuits on a selected scan line is set to a specific state.

In this manner, a set period (e.g., blanking scan period) is provided in the time-division gradation display method, and the current value is successively reset in one or more signal output circuits within one blanking scan period. This enables the signal output circuit to output the image data signal successively with the reset of the current value, both in one frame period. Accordingly, the conventionally required selector circuit for selecting a pair of DCC circuits will not be required. This enables the number of unit circuits in the driving circuit to be reduced, thereby reducing the size and operating frequency of the driving circuit. This in turn enables the driving circuit to have improved reliability and improved productivity, thus reducing the size of the display device provided with the driving circuit.

With at least one additional blanking scan, the same effect can also be obtained in a display device in which only one scan is made in one frame period as in the analog driving mode.

Further, by providing a pre-charge period for the pixel circuit in each scan period, and by causing the signal output circuit to output the OFF signal in the pre-charge period, a reset period for the current value of the signal output circuit can extend over a blanking scan period and the pre-charge period of the next scan period immediately following this blanking scan period. This enables the signal output circuit to more accurately store a smaller current value.

It is preferable in the driving circuit that the signal output circuit holds one or more current values of the ON signal.

With the signal output circuit holding at least one current value that corresponds to data used for display, and with the current value set to represent two states for turning on or off the electro-optic element, the time-division gradation display method can be used to carry out gradation display. Further, with a plurality of signal output circuits holding different current values, gradation display can be carried out on the electro-optic element with more than two display states. The current can be supplied by a constant current source, for example.

The signal output circuit used in the respective preferred embodiments preferably includes at least two switching elements, wherein a first switching element controls the output state of the signal output circuit, and a second switching element is controlled to store a current value of the constant current source and to flow the current of the stored current value. It is also preferable that the signal output circuit converts a voltage signal into a current signal by controlling the ON state of the first switching element with an input voltage signal, and by turning on or off the output current of a predetermined current value outputted from the second switching element.

With this structure, an externally supplied digital image data signal to the data driving circuit can be used as a signal for controlling the first switching element.

It is preferable in the driving circuit that the control circuit controls the hold operation of the signal output circuit such that the signal output circuit resetting its current value is switched at every successive selecting of scan lines including pixel circuits that receive the OFF signal in the set period.

The reset period for an output value of the signal output circuit cannot exceed one horizontal scan period (1H), and it is difficult in a structure of a common display device to reset the output values of all signal output circuits within one horizontal scan period. Thus, in resetting the output value of the signal output circuit with the control circuit in synchronism with the set period in which the OFF signal is sent to all pixel circuits, the signal output circuit resetting the current value is switched in every set period.

For example, when the number of scan lines in the display device is L, the set period in which the OFF signal is sent to all pixel circuits appears L times within one frame period. Thus, in the entire one frame period, the signal output circuits can reset L different current values.

It is preferable in the driving circuit that the signal output circuit includes: first and second transistors whose gate terminals are connected to each other, and whose input terminals are connected to a common power line; a capacitor connected between the input terminals and the gate terminals of the first and second transistors; and a third transistor whose one of input and output terminals is connected to an output terminal of the first transistor, wherein the capacitor and the first through third transistors include a current mirror structure in which a voltage according to a current that flows through the first transistor is held in the capacitor by controlling a gate voltage of the third transistor with the control circuit, and the held voltage is used to flow a current of the same current value to the first and second transistors.

It is also preferable in the driving circuit that the signal output circuit includes: a first transistor whose input terminal is connected to a power line; a capacitor connected between the power line and a gate terminal of the first transistor; and a second transistor whose input terminal is connected to an output terminal of the first transistor, and whose output terminal is connected to the gate terminal of the first transistor, wherein the capacitor and the first and second transistors include a current copier structure in which a gate voltage of the first transistor when there is a current flow in the first transistor is held in the capacitor by controlling a gate voltage of the second transistor with the control circuit, and the held voltage is used to control the current that flows through the first transistor.

With these structures of the signal output circuit, the current path of the reference current supplied from the constant current source and the like is cut by the third transistor in the case of the current mirror structure, and by the second transistor in the case of the current copier structure. The same current value can be obtained again by applying a voltage to the input terminal of the second transistor in the case of the current mirror structure, and to the input terminal of the first transistor in the case of the current copier structure.

In either the current mirror structure or the current copier structure, the transistors used in the circuit may be of a p-type or n-type, provided that a control signal for each transistor and the position of the capacitor are appropriately selected according to the current flown through the circuit.

However, compared with the current copier structure, the current mirror structure is prone to cause variations in the output current when the characteristics of the transistors making up the circuit vary. For this reason, the current copier structure is more preferable as a structure of the signal output circuit for holding a current value.

It is preferable in the driving circuit that H≧T, m≧n, and W≧H are satisfied, where H is a horizontal scan period, T is a time required for the signal output circuit to reset a current value of the ON signal, m is the number of scan lines in the display device, n is the number of data lines, and W is a time required to apply a current value to the pixel circuit, wherein n also represents the number of signal output circuits.

It is also preferable that driving circuit further includes: a select-output circuit which selects a data line and outputs thereto the output of the signal output circuit when H≧dT, m≧n/d, and W≧H/d are satisfied and with the one horizontal scan period being divided into d periods, where H is a horizontal scan period, T is a time required for the signal output circuit to reset a current value of the ON signal, m is the number of scan lines in the display device, n is the number of data lines, W is a time required to apply a current value to the pixel circuit, and d is an integer of not less than 2, wherein n/d represents the number of signal output circuits.

In these two preferable examples, the former corresponds to the latter when d=1. The former represents the case where one complete horizontal scan period is required to apply a current value to the pixel circuits. Further, in the former example, while the source driving circuit requires n signal output circuits as a whole, it does not require a selector circuit such as the 1-to-2 selector. Indeed, use of a selector circuit is not preferable in the light of the aperture ratio of the pixels, because it increases the number of control lines in the pixel circuit, as will be described later. This is particularly prominent and a selector circuit should not be used in a high-definition display device using the bottom-emission configuration.

In contrast, the latter corresponds to the method of the conventional example in which one horizontal scan period is divided in half to operate the circuit, using the 1-to-2 selector. However, it differs from the conventional example in that only half of the signal output circuits are required. This enables a single signal output circuit to be shared by a plurality of data lines, wherein the total number of signal output lines is the number obtained by dividing the total number of data lines by the number into which one horizontal scan period is divided.

Thus, provided that there is a sufficient time to apply signals to the pixel circuits, the number of signal output circuits required as a whole in the source driving circuit can be reduced to (n/d) by dividing the number of outputs of the signal output circuits by d, even when one horizontal scan period is divided into d periods as in the conventional example. This greatly reduces the area occupied by the driving circuit 4 and thereby reduces the size of the display device.

In the event where the 1-to-2 selector is used as in the conventional example, the gate driving circuit requires two kinds of scan signals to prevent the signal from being applied to pixel circuits disconnected by the selector. The additional scan line in the pixel circuit is not preferable in terms of aperture ratio. However, the driving circuit structure using the selector can be effectively used when the pixel circuits have a top emission configuration, because in this case the number of scan lines has little influence on the pixel structure.

It is preferable in the driving circuit that when H≧bT, and m≧n/b are satisfied, where H is a horizontal scan period, T is a time required for the signal output circuit to reset a current value of the ON signal, m is the number of scan lines in the display device, n is the number of data lines, and b is an integer of not less than 2, the control circuit controls the hold operation of the signal output circuit to enable the current value to be successively reset in groups of b signal output circuits at every successive selecting of scan lines including pixel circuits that receive the OFF signal in the set period.

When b=1, the current value of the signal output circuit needs to be reset within one frame period when the number of data lines is smaller than the number of scan lines. On the other hand, when the number of data lines is greater than the number of scan lines, the current value of the signal output circuit needs to be reset over a plurality of frame periods. Thus, it is difficult to implement the present invention when, for example, the driving circuit is designed such that the hold period of the current value cannot be made sufficiently longer than one frame period. However, the signal output circuit only needs to be provided one for each circuit that generates a timing for resetting the current value for the signal output circuit. Thus, provided that a sufficiently long hold period is provided for holding the current value of the signal output circuit, preferred embodiments of the present invention can use the b=1 configuration and be implemented with a relatively small circuit for resetting the current value of the signal output circuit.

On the other hand, when b≧2, a selector circuit for dividing the signal is required between the signal output circuit and the circuit that generates a timing signal for resetting the current value of the signal output circuit, wherein the number of selector circuits is determined by b. As a result, the circuit size is increased. It should be noted that the present invention can be implemented by suitably selecting a value of b, even when the number of data lines is greater than the number of scan lines and when the circuit design does not allow the hold period to exceed one frame.

It is preferable in the driving circuit that, when Th>Tf is satisfied where Th is a time available for the signal output circuit to hold a current value, and Tf is one frame period, the control circuit controls the hold operation of the signal output circuit such that the current value is reset for all signal output circuits over a plurality of frame periods, wherein the reset of the current value is successively carried out, starting from one of the signal output circuits in synchronism with an externally supplied start command but without synchronizing the reset timing of the current value with a start of one frame period.

The only time requirement for resetting the current value of the signal output circuit is that the current value be reset in synchronism with the set period in which the OFF signal is supplied to all data lines. This is because the reset period can extend over a plurality of frame periods when the hold period for holding the current value of the signal output circuit is longer than one frame period.

In this way, the circuit that supplies a timing to the signal output circuit to reset the current value can operate at a lower operating frequency, thereby reducing power consumption of the circuit. By carrying out the method of resetting the current value of the signal output circuit over a plurality of frame periods either alone or in combination with the method of resetting current values of a plurality of signal output circuits within one horizontal scan period, the number of signal output circuits that require reset of their current values within one horizontal scan period can be reduced, even when the number of data lines, i.e., the number of signal output circuits is considerably greater than the number of scan lines. This enables the driving method to accommodate a display device with a notably large aspect ratio.

It is preferable in the driving circuit that the control circuit controls the hold operation of the signal output circuit to enable the current value to be successively reset in a plurality of signal output circuits at every successive selecting of scan lines including pixel circuits that receive the OFF signal in the set period, wherein the reset of the current value is carried out for all the signal output circuits by repeating the successive resetting of the current value in a cycle, starting from one of the signal output circuits in synchronism with an externally supplied start command but without synchronizing the reset timing of the current value with a start of one frame period, and immediately after a last signal output circuit of a previous cycle. That is, the current values of all the signal output circuits can be reset in a time period shorter than one frame period Tf.

As noted above, the only time requirement for resetting the current value of the signal output circuit is that the current value be reset in synchronism with the set period in which the OFF signal is supplied to all data lines. Thus, with the foregoing hold operation, the current values of the signal output circuits can be reset within the hold time Th of the current value even when the hold time Th is shorter than one frame period Tf in the signal output circuit, provided that the following conditions are met.

$$H \geqq bT,\ m \geqq n/b, \text{ and } Th \geqq Tf \times \{(n/b)/m\},$$

where H is the horizontal scan period, T is the time required for the signal output circuit to reset the current value of the ON signal, m is the number of scan lines in the display device, n is the number of data lines, and b is an integer of not less than 2.

In the circuit of a current mirror structure or current copier structure realizing the signal output circuit, the hold time of the current value is determined by the capacitance of the capacitor in the circuit. As a rule, the capacitance of the capacitor increases as the hold time increases. Generally, the hold period is sufficiently longer than one frame period, and the current value is set per frame. However, the hold period Th may be shorter than one frame period when the hold period Th of the signal output circuit satisfies the foregoing conditions in the hold operation of the respective preferred embodiments. In this way, the capacitance provided in the signal output circuit can have a smaller capacitance, thereby reducing the area occupied by the driving circuit.

The method in which the current value of the signal output circuit is reset in a period shorter than one frame period, or over a plurality of frame periods without synchronizing with the frame period may be carried out either alone or in combination with the method in which the current values of a plurality of signal output circuits are reset within one horizontal scan period. In this way, the current values of all the signal output circuits can be reset within the hold period Th for the current value of the signal output circuit, even when the number of data lines, i.e., the number of signal output circuits is considerably greater than the number of scan lines. This enables the driving method to accommodate a display device with a notably large aspect ratio.

In the display device of the Second Preferred Embodiment, a display state of the electro-optic element is changed M times within one frame period, and the display state is set to be any one of R display states, so as to carry out N gradation display that satisfies $N \leqq R^M$, where M and R are each an integer of not less than 2.

The relationship $N \leqq R^M$ basically holds for any value of M. However, for ease of explanation, the following considers two cases where M=1 and M≧2 separately, of which the latter is described first. Further, the description will generally be made based on the analog driving mode for M=1, and the digital driving mode for M≧2.

As described in the BACKGROUND OF THE INVENTION section, a problem of the matrix display device using an electro-optic element of, for example, an organic EL element is that it often causes variations in the output luminance of the organic EL element even for the same input image data signal. This occurs due to the variations in the characteristics of the organic EL element itself, as well as the variations in the characteristics of the TFTs (switching elements) making up the circuit. It is therefore difficult to obtain high-quality gradation display by setting a plurality of display states for the electro-optic element once in one frame period, because it often results in gradation error.

In order to avoid such a problem, many display devices using the electro-optic element provides only two display states for the electro-optic element to sufficiently maintain its quality of gradation display. For example, the electro-optic element has a state with zero luminance (OFF), and a state with a luminance obtained by driving the TFT element in a domain where the characteristic variations of the TFT element are small. With these two display states, the display devices use the time-division gradation display method in which one frame period is divided into a plurality of sub frames, and ON/OFF of these sub frames is selected to combine the number of gradations in the display element with the number of times the electro-optic element is turned on within one frame period.

It is preferable in the display device that the electro-optic element has corresponding data, the number of which is represented by α, and at least one of the α data includes data that turns off the electro-optic element in the set period, and the display device outputs the ON signal or OFF signal to the data line according to the α data within continuous α select periods.

A driving method that realizes the driving circuit of various preferred embodiments of the present invention and accommodates any number of scan lines is disclosed in Japanese Publication for Unexamined Patent Publication No. 127906/1997 (Tokukaihei 9-127906) in which, for example, a blanking scan period is provided within one frame period. The blanking scan period corresponds to the set period of preferred embodiments of the present invention in which the OFF signal is outputted to all data lines.

The blanking scan is independently carried out from the application of other image data signals. In order to carry out the blanking scan, a signal that initializes the display state needs to be supplied to the pixel circuit irrespective of the signal supplied to the data lines. The foregoing Tokukaihei 9-127906 discloses using ferroelectric liquid crystal as the electro-optic element, and the blanking scan is carried out by initializing the display state with a negative voltage applied to the scan lines. In the case where an organic EL element is used, the pixel circuit additionally requires, for example, a TFT element for the initialization, and a signal line for controlling the TFT element. In this case, the aperture ratio of the pixels is decreased, necessitating the luminance of each pixel to be increased to maintain the luminance of the display device as a whole. However, given the life expectancy of the organic EL element, the luminance should be kept at the lowest possible level.

To this end, the display state of the electro-optic element is changed M times within one frame period, and the display state is set to any of R display states according to the output current of the signal output circuit, so as to carry out N gradation display ($N \leqq R^M$), where M and R are each an integer of not less than 2. Then, the input D-bit gradation data (where D is an integer of not less than α) is converted into α data including the OFF data. The data so obtained is used as the image data which the driving circuit outputs within a set period of a scan line. Here, M is controlled to be smaller than $R^{\alpha}$, and the data successively supplied to the data lines within the select periods are switched for each select period.

In driving the display device with the time-division gradation display method using data including the OFF data, any number of scan lines can be driven in the display device at the timing of any blanking scan period in a scan, without additionally providing an initializing TFT or initializing scan lines.

In the driving method, all of the data supplied from the driving circuit within the set period of the scan line are selected only once through one frame. Here, when the data includes the OFF data, i.e., the blanking signal, it is ensured that the blanking signal is selected once for all scan lines within one frame. That is, when the number of scan lines is N, N blanking scan periods can be provided in one frame.

The display device of the First Preferred Embodiment includes a driving circuit that can accommodate the analog driving mode. In the display device, the display state of the electro-optic element is changed once in one frame, and the display state is set to any of R display states, so as to carry out N gradation display ($N \leqq R$), where R is an integer of not less than 2. Further, the display device scans the scan lines more than once in one frame, wherein the scan is made in the display period in which the ON signal or OFF signal is applied to the pixel circuit for display, and in at least one set period.

This is for the following reasons. In the analog driving mode, the image data signal for display (ON signal or OFF signal) is generally outputted to the pixel circuit only once (M=1) in one frame period. Thus, element life is generally improved by lowering the instantaneous luminance, which is achieved by carrying out the scan once in one frame period and by using the rest of the frame period as the ON period. In order to reset the output value of the signal output signal using the set period in which the OFF signal is outputted to all the data lines, at least one blanking scan needs to be carried out, in addition to the scan that is generally made once to send the image data signal.

In the case where the active-matrix display device uses an organic EL element as the electro-optic element for example, the element emits light of a constant luminance for most of one frame period. This often causes blur in the display when a moving image is displayed. On the other hand, in the display in which the electro-optic element emits light throughout most of one frame period and images are refreshed line by line within one frame period, the displayed image does not change to the next image at once. That is, some portions of the previous image are left behind, causing the after-image phenomenon. This is not a problem in a still image in which images do not move, but it causes blur in fast moving images for example. One preferable method to prevent such a problem is to insert a black image on purpose. This can be carried out, for example, by periodically making a blanking scan separately from that scan that is carried out to send the image data signal.

It is preferable that the display device including the driving circuit further includes a potential applying circuit for rendering the pixel circuit with a potential that enables the ON signal to be quickly applied to the pixel circuit, the potential being applied before the signal output circuit applies the ON signal or OFF signal to the pixel circuit in a horizontal scan period, the control circuit controlling the hold operation of the signal output circuit to enable the current value of the ON signal to be reset in a potential applying period in which the potential applying circuit applies the potential, and that is provided in a next scan period that follows the set period.

In the control method in which a current signal is applied to the pixel circuit for display, the time required to apply the signal to the pixel circuit increases as the current value is decreased. This phenomenon occurs because a signal of a considerably small, restricted current value is applied to the capacitor with a relatively large capacitance (potential holding capacitance in the pixel circuit, parasitic capacitance of the wiring, etc.). In order to avoid such a problem, it is preferable that pre-charge be carried out before applying the current signal, so that a suitably selected voltage signal brings the potential of the capacitor close to the potential that is obtained when the ON signal is applied. It is therefore preferable that a pre-charge circuit be provided, separately from the signal output circuit, as a potential applying circuit for outputting a voltage signal, and that the pre-charge circuit be operated exclusively from the signal output circuit and only for a suitable period from the start of each scan period, and that the signal output circuit then output the current signal (ON signal) in the next usual write operation.

Controlling the signal output circuit and the pre-charge circuit in this manner enables the signal output circuit to send the OFF signal in any scan period, from the start of the scan period to the end of pre-charge. Specifically, the current value of the signal output circuit can be reset in the pre-charge period (potential applying period) for any scan period. Thus, if a scan period immediately preceding another scan period is a blanking scan period, the signal output circuit can continuously output the OFF signal until the end of a pre-charge period of the scan period.

Thus, with the potential applying circuit such as the pre-charge circuit, and with the signal output circuit outputting the OFF signal in the potential applying period for the reset of the current value, the current value can be reset until the end of the pre-charge period in the next scan period, thus extending the reset period of the current value. The longer reset period of the current value enables the current value to be stored more accurately. Further, a smaller current value can be set.

It is preferable in the display device that the driving circuit and the pixel circuit include a switching element realized by a thin-film transistor. It is also preferable in the display device that the switching element is made of polycrystalline silicon.

With the use of the thin-film transistor (TFT) for the switching element of the pixel circuit and the driving circuit, a required current value for turning on the electro-optic element can be flown.

Note that, as long as the foregoing condition is met, the TFT may be either a p-type transistor or n-type transistor. Further, the semiconductor material of the TFT may be amorphous, or more preferably low-temperature polycrystalline silicon or CG silicon to provide enough current value needed to turn on the element with high luminance.

It is preferable in the display device that the driving circuit is either entirely or partially integrated with a display panel on which the electro-optic element is provided. In this way, the size of the display device can be made smaller, and fabrication cost can be reduced.

It is preferable in the display device that the electro-optic element is an organic electroluminescence (EL) element. The electro-optic element may be of any type as long as it controls the emission intensity by a current value, but an organic EL element is particularly preferable for the current-controlled driving circuit.

The present invention being thus described, it will be obvious that the present invention and all of its preferred embodiments may be varied, combined or otherwise modified in many ways. Such variations are not to be regarded as a departure from the spirit and scope of the present invention, and all such modifications as would be obvious to one skilled in the art are intended to be included within the scope of the following claims.

The invention claimed is:

1. A display device comprising:

a plurality of scan lines;

at least one data line;

a pixel circuit provided with an electro-optic element and disposed in a matrix at each intersection of the scan lines and the at least one data line;

a driving circuit arranged to drive the pixel circuit, said driving circuit including:

a signal output circuit which holds a current value of a reference ON signal that turns on the electro-optic element, said signal output circuit outputting the ON signal to the at least one data line with a current value held according to ON data, and outputting an OFF signal to the at least one data line so as to turn off the electro-optic element according to OFF data; and a control circuit which controls the hold operation of the signal output circuit to so as enable the ON signal to reset its current value within a set period in which a display state of all pixel circuits on a selected scan line is set to a specific state; and a pre-charge circuit arranged to provide the pixel circuit with a potential that enables the ON signal to be quickly applied to the pixel circuit, the potential being applied before the signal output circuit applies the ON signal or OFF signal to the pixel circuit in a horizontal scan period, the control circuit controlling the hold operation of the signal output circuit to enable the current value of the ON signal to also be reset in a pre-charge period in which the pre-charge circuit applies the potential, and that is provided in a next scan period that follows the set period.

2. The display device as set forth in claim 1, wherein the driving circuit and the pixel circuit include a switching element including a thin-film transistor.

3. The display device as set forth in claim 2, wherein the thin-film transistor is made of polycrystalline silicon.

4. The display device as set forth in claim 1, wherein the driving circuit is either entirely or partially integrated with a display panel on which the electro-optic element is provided.

5. The display device as set forth in claim 1, wherein the electro-optic element is an organic electroluminescence element.

* * * * *